United States Patent [19]

Sato

[11] 4,179,989

[45] Dec. 25, 1979

[54] CONSTANT PRINTING PRESSURE MECHANISM FOR PORTABLE LABEL PRINTING AND APPLYING MACHINE, OR THE LIKE

[75] Inventor: Yo Sato, Tokyo, Japan

[73] Assignee: Kabushiki Kaisha Sato Kenkyusho, Tokyo, Japan

[21] Appl. No.: 787,937

[22] Filed: Apr. 15, 1977

[30] Foreign Application Priority Data

Apr. 26, 1976 [JP] Japan ..... 51-46606

[51] Int. Cl.[2] ..... B41J 3/00; B41J 5/00; B41F 1/54

[52] U.S. Cl. ..... 101/291; 101/288; 400/158; 400/457; 400/460; 400/652

[58] Field of Search ..... 101/287, 288, 291, 292; 400/460, 460.1, 460.2, 457, 458, 649, 652, 158, 158.1

[56] References Cited

U.S. PATENT DOCUMENTS

| | | | |
|---|---|---|---|
| 1,058,688 | 4/1913 | Myers | 400/458 |
| 1,952,192 | 3/1934 | Alti | 400/457 |
| 2,073,902 | 3/1937 | Olivetti | 400/652 |
| 2,523,855 | 9/1950 | Zgranik | 400/652 |
| 2,901,080 | 8/1959 | Zeamer | 400/457 |
| 3,595,167 | 7/1971 | Wirth | 101/287 |
| 4,072,105 | 2/1978 | Becker et al. | 101/288 |
| 4,125,419 | 11/1978 | Hamisch, Jr. | 101/290 |
| 4,125,420 | 11/1978 | Hamisch, Jr. | 101/288 |

FOREIGN PATENT DOCUMENTS

| | | | |
|---|---|---|---|
| 2152375 | 4/1973 | Fed. Rep. of Germany | 400/397 |
| 1055211 | 1/1967 | United Kingdom | 400/457 |
| 2152375 | 4/1973 | United Kingdom | 400/397 |

*Primary Examiner*—William Pieprz

*Attorney, Agent, or Firm*—Ostrolenk, Faber, Gerb & Soffen

[57] ABSTRACT

A constant printing pressure mechanism for a portable label printing and applying machine; the machine has a printing head which is interlocked with a hand lever and it has a platen that carries a label strip disposed opposite to the printing head, the constant pressure mechanism comprises: a constant pressure means to turn the platen up against the type faces of the printing head with a constant pressure in synchronism with the downward movement of the printing head, and a means to release the platen slightly from the printing head immediately after the printing operation. Additionally disclosed are means for adjusting the label striking angle of the printing head type faces by twisting the type face orientations; a linkage arrangement connected with the hand lever for moving inking rollers across the type faces and out of the way of the type faces at printing time; a device for passing the label strip which opens a pathway for the label strip to be inserted into the machine and then recloses the pathway to hold the label strip to a feeding means; a device which rotates the label strip feed roller a desired distance and mechanically blocks inertial overrolling by the feed roller; and a device which regulates the size of the loop formed in the backing strip at the point it is peeled from the overlying label strip.

10 Claims, 40 Drawing Figures

46a
41'

41'
46b 5b
127
104
6
104a
6b
126
128
135
6a
108
105
103
122
117
120
103a
102

41
42
43
45
44
41'
46'

CONSTANT PRINTING PRESSURE MECHANISM FOR PORTABLE LABEL PRINTING AND APPLYING MACHINE, OR THE LIKE

BACKGROUND OF THE INVENTION

This invention relates to a constant pressure mechanism for a portable label printing and applying machine, in which a pressure-sensitive self-adhesive label strip is intermittently delivered in single label lengths on a platen by the squeezing operation of a hand grip and a hand lever. A printing head above the label strip and the platen under the label strip are moved separately but toward each other so as to exert a constant printing pressure on the label strip for highly precise printing.

In conventional label printing and applying machines, the printing pressure of a printing device against a label is liable to vary depending upon whether the hand lever is squeezed strongly and weakly. Further, when the hand lever is squeezed for a long time and then released rapidly, the quantities of ink applied to labels differ even though the printing pressure is made constant. Therefore, invariable precision in printing has never been attained.

In the past, however, such indistinctly printed labels have caused no inconvenience because they are in practice used for human readable labels for price indication and they can be almost read with the naked eye when customers buy several goods or cashiers totalize sales.

In recent years, POS (point of sales) systems have been widely adopted all over the world. In these systems, management data such as stock, sales, the relation between customers and commodities required, calculation of profits, etc. are processed and memorized by electronic computers. In this system, machine readable bar codes or characters for OCR (optical character reader) printed on labels are read out by optical readers connected to computers in place of cashiers. Accordingly, it is necessary that label printing always be precise.

In order to always attain highly precise printing, the type faces of the printing head must be pressed against the surfaces of labels with a constant pressure even when the hand lever is squeezed strongly or weakly. The type faces of the printing head must contact the surfaces of labels for a definite time length with uniform printing pressure no matter what the duration of a squeeze of the hand lever may be. Accordingly, label printing machines having constant printing pressure mechanisms are now demanded.

In connection with the art of constant pressure mechanisms, there have been several applications filed by the inventor hereof:

I. A movable platen system in which a printing head is fixed to the machine frame and a platen is moved through its connection with a hand lever:
   - U.S. patent application Ser. No. 681,251, filed Apr. 28, 1976, for "Portable Label Printing Machine;"
   - U.S. patent application Ser. No. 720,225, filed Sept. 2, 1976, for "Print Head Constant Pressure Mechanism for Labeling Machine;"
   - U.S. patent application Ser. No. 723,556, filed Sept. 15, 1976, for "Portable Label Printing Dispensing Machine."

II. A movable printing head system in which a platen is fixed to the machine frame and a printing head is moved through its connection with a hand lever:
   - U.S. patent application Ser. No. 750,845, filed Dec. 15, 1976, for "Portable Label Printing and Applying Machine."

BRIEF SUMMARY OF THE INVENTION

It is the primary object of the present invention to provide an improved constant pressure mechanism for a label printing and applying machine, or the like, which mechanism exerts a constant printing pressure in printing operation irrespective of the strength and duration of the squeezing of a hand grip and a hand lever of the machine.

Another object of the present invention is to provide a constant pressure mechanism used for a label printing and applying machine of the type described above, which is effective for attaining high precision of label printing, particularly adaptable to an optical character reading system.

A further object of the present invention is to provide a constant pressure mechanism for a label printing and applying machine which is relatively compact and simple and able to be produced easily at low cost.

As described above, the constant pressure mechanism is attached to a label printing and applying machine of the type in which a printing head is connected to a hand lever and a platen for supporting the labels of a label strip is disposed opposite to the printing head. The constant pressure mechanism includes a constant pressure means to raise the platen against the type faces of the printing head with a constant printing pressure in synchronism with the downward movement of the printing head, and it also includes a releasing means to separate the platen slightly from the printing position immediately after the printing operation.

The constant pressure means for the platen according to the present invention comprises a hook which is actuated by the hand lever, action arms which are brought into engagement with the hook and are provided with constant pressure springs, contact rollers attached to rocking arms that are supported by the action arms, and other contact rollers secured to the platen.

The constant pressure means may be provided with first pushing pawls which are actuated by the squeezing of the hand lever, rotation pins formed on rotary discs and engaging with the first pushing pawls, action members engaging with the above rotation pins to move the rotary discs, engaging grooves having stopping sections and sliding sections for the above action members, constant pressure springs operative with the action members, and action levers to move the platen.

Furthermore, release springs to urge the platen downward are attached to the platen to serve as releasing means to separate the platen from the type faces of the printing head.

When the hand lever is squeezed, the platen is retained as it stands until the hand lever and the yoke arms having the printing head are moved for the greater part of rotation angle (17 degrees out of 18 degrees), and the platen is then moved up and down relative to the type faces of the printing head in a moment in the final stage of the rotation (1 degree) of the hand lever squeezing.

The constant pressure mechanism of the present invention has the following characteristic features and advantages:

(1) The platen is moved only to a slight degree so that the type faces are lightly pressed against the labels supported on the platen. Precise printing can be attained without double printing.

(2) The contact pressure of the type faces on the labels is relatively small so that the types may give long service.

(3) Since the platen is only slightly moved, the constant pressure springs also give long service. At the same time, the force necessary for squeezing the hand lever can be reduced, which facilitates the operation of the machine.

(4) A hinged link plate for vertically moving the platen over a long distance is not necessary, so that blocking of the feeding movement of the label strip can be avoided.

(5) The machine can be made easily as the internal mechanism is compact.

(6) The number of required parts is small so that the mechanism can be produced at low cost and can work well without trouble.

Other aspects and features of a label printing and applying machine are also described herein, including means for adjusting the label striking angle of the printing head type faces by twisting the type face orientations; a linkage arrangement connected with the hand lever for moving inking rollers across the type faces and out of the way of the type faces at printing time; a device for passing the label strip which opens a pathway for the label strip to be inserted into the machine and then recloses the pathway to hold the label strip to a feeding means; a device which rotates the label strip feed roller a desired distance and mechanically blocks inertial overrolling by the feed roller; and a device which regulates the size of the loop formed in the backing strip at the point it is peeled from the overlying label strip.

BRIEF DESCRIPTION OF THE DRAWINGS

These and other objects and features of the invention will become more apparent from the following description taken in connection with the accompanying drawings, in which:

FIGS. 1 to 8 show the first embodiment of the constant pressure mechanism of the present invention, in which:

FIG. 1 is a side view of a label printing and applying machine which is provided with the constant pressure mechanism;

FIG. 2 is a plan view of the machine;

FIG. 3 is a side view of the machine in which the machine frame on the near side is removed and the hand lever is released;

FIG. 4 is a perspective view of the main part of the constant pressure mechanism;

FIG. 5 is a side view of the label printing and applying machine, in which the machine frame on the near side is removed and the hand lever has been squeezed to the state immediately before the disengagement of a constant pressure hook;

FIG. 6 is a side view of the machine at the time of printing;

FIG. 7 is a side view of the machine immediately after the printing stroke, in which the platen has been slightly separated from the type faces of the printing head;

FIG. 8 is a side view of the same just before the rest position with the hand lever being released;

FIGS. 9 to 12 show the second embodiment of the constant pressure mechanism of the present invention, in which:

FIG. 9 is a side view of a label printing and applying machine having the constant pressure mechanism, in which the machine frame on the near side is removed and the hand lever is released;

FIG. 10 is an exploded perspective assembly drawing of the main portion of this embodiment of the constant pressure mechanism;

FIG. 11 is a side view of the label printing and applying machine, in which the machine frame on the near side is removed and the hand lever has been squeezed to the printing position of the printing head and the platen;

FIG. 12 is a side view of the machine immediately after the printing stroke, in which the platen has been slightly released;

FIGS. 13 to 26 show embodiments of angle adjusting devices for type faces, in which:

FIG. 13 is a vertically bisected view of a label printing and applying machine having this device;

FIGS. 14 to 19 show a first embodiment of angle adjusting device, in which:

FIG. 14 is a partially cutaway front view of a printing head having this first embodiment;

FIG. 15 is a vertical bisectional side view of this embodiment;

FIG. 16 is an exploded perspective, assembly drawing of this embodiment;

FIG. 17 is a vertical bisectional front view of this embodiment taken on a plane that is at right angles to the plane of FIG. 15;

FIG. 18 is a partially cutaway side view of this embodiment in which the posture of the angle adjusting device is normal;

FIG. 19 is also a partially cutaway side view of this embodiment, in which the angle of type faces is not adjusted;

FIG. 20 is a perspective view of a tape-like label strip;

FIGS. 21 and 22 show a second embodiment of angle adjusting device, in which:

FIG. 21 is a partially cutaway front view of a printing head;

FIG. 22 is a vertical bisectional view of that printing head;

FIG. 23 is a perspective view of another tape-like label strip;

FIG. 24 is a vertical bisectional view of a printing head with a third embodiment of an angle adjusting device;

FIG. 25 is a plan view of a label for use in a three-line system, which label is printed with the printing head of the embodiment before angle adjustment;

FIG. 26 is a plan view of a bar code label which is printed with the same printing head before angle adjustment;

FIGS. 27 to 32 show an embodiment of an inking device, in which:

FIG. 27 is a side view of a label printing and applying machine that is provided with the inking device, in which the machine frame on the near side has been removed;

FIG. 28 is a perspective view of the main portion of the inking device;

FIG. 29 is a side view of the inking device in a rest position;

FIG. 30 is a side view of the inking device in which a push-up portion is brought into contact with a contact pin in a multi-link mechanism of the inking device;

FIG. 31 is also a side view of the inking device showing the state in which ink is applied to the type faces of the printing head by inking rollers;

FIG. 32 is a side view of the inking device in which the multi-link mechanism and the inking rollers are stored within the machine body;

FIGS. 33 to 36 show a label feeding device, in which:

FIG. 33 is a side view of a label printing and applying machine having the label feed device;

FIG. 34 is a perspective view of the label feeding device;

FIG. 35 is a vertical cross-sectional view of the label feeding device in which the locking lever and bottom cover are locked after feeding the label strip;

FIG. 36 is a vertical cross-sectional view of the feeding device in which the label strip is being inserted;

FIGS. 37 and 38 show an embodiment of an inertial rotation preventing device for a delivery roller, in which:

FIG. 37 is a side view of the device in an engaged state; and

FIG. 38 is a side view of the same in an operating state;

FIGS. 39 and 40 show an embodiment of a label peeling regulating device for the label strip, in which:

FIG. 39 is a vertical cross-sectional view of the device before adjusting; and

FIG. 40 is a vertical cross-sectional view of the device after adjusting.

DETAILED DESCRIPTION OF THE PREFERRED EMBODIMENTS

Referring to the accompanying drawings, embodiments of the present invention are described in detail.

Figure 1:
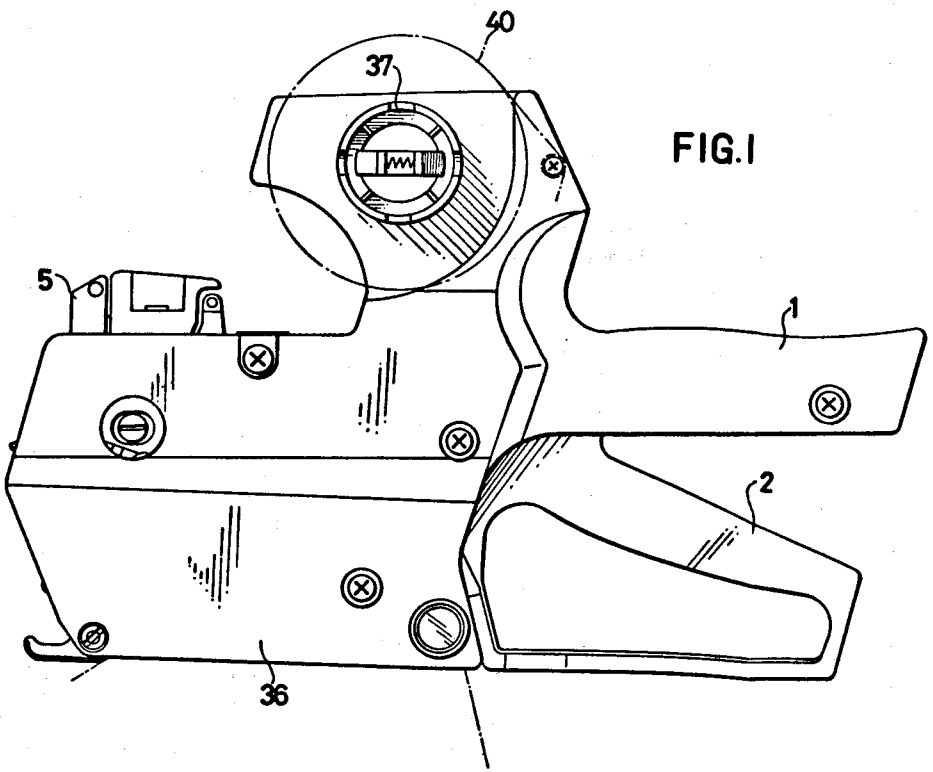
Figure 2:
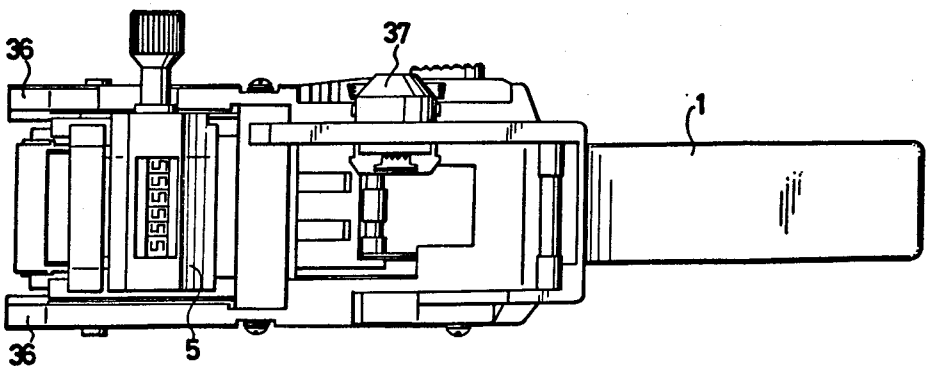
Figure 3:
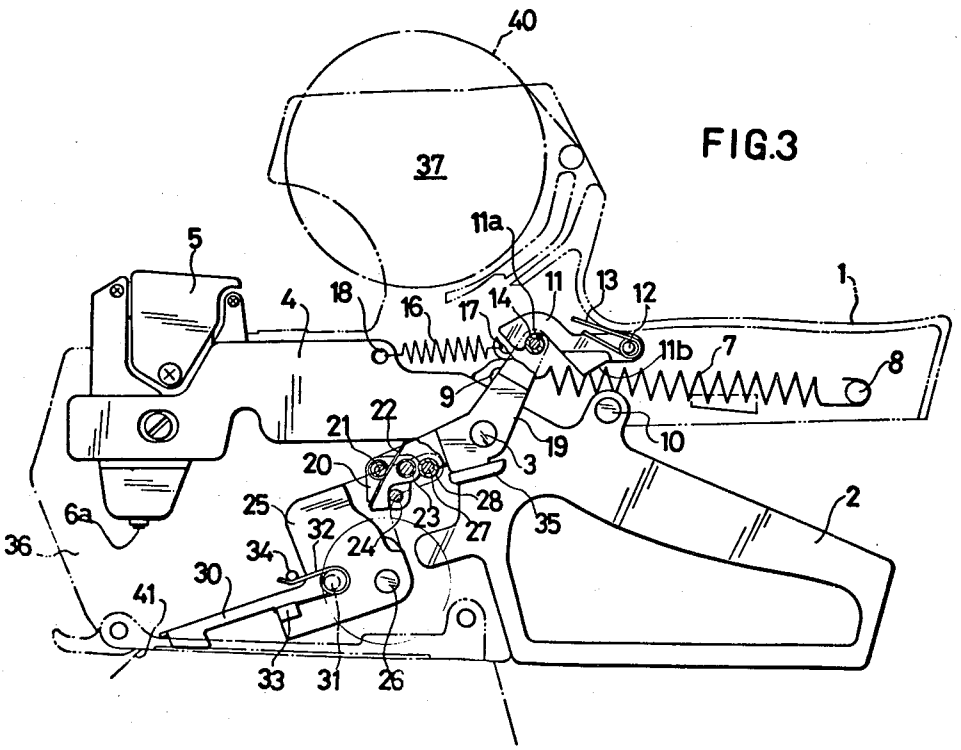
Figure 4:
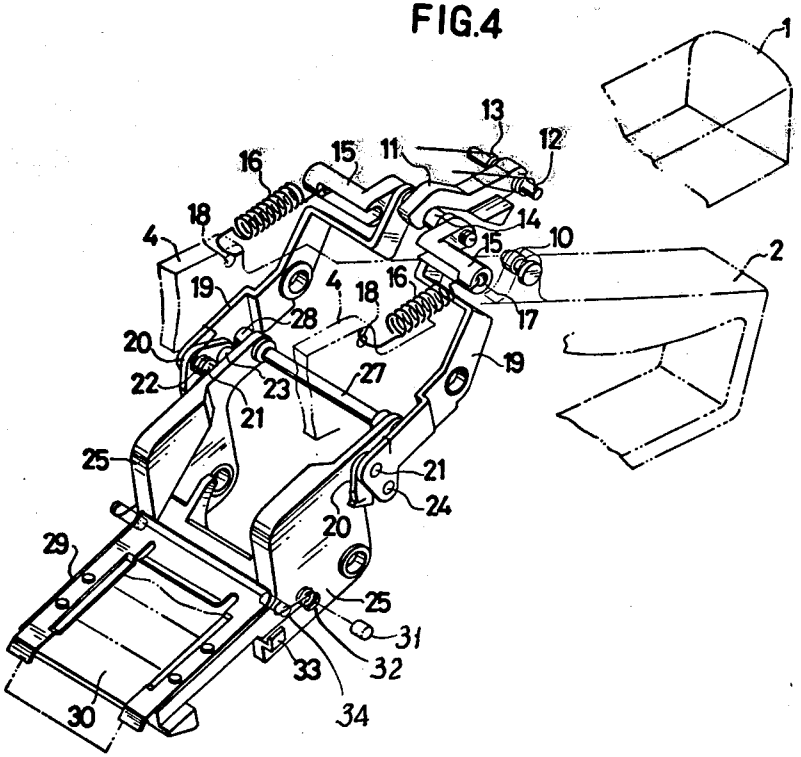

The first embodiment of the constant pressure mechanism of the invention is shown in FIGS. 3 to 8, and especially in FIGS. 3 and 4. A portable label printing and applying machine having the constant pressure mechanism of the invention is shown in FIGS. 1 and 2. In the machine, the rear parts of its machine frames 36 extend to form an integral hand grip 1. A hand lever 2 is pivotally secured on a pivot shaft 3 that is attached to the machine frames 36. The lever 2 can be pivoted about the shaft 3 relative to the hand grip 1 by squeezing the hand lever 2. The front portion of the hand lever 2 is provided with bifurcated yoke arms 4 that support a printing head 5 at their free ends. The printing head 5 has a plurality of stamp belts that are arrayed side by side across the space between frames 36. Type faces 6*a* for printing labels are disposed on the under surface of the printing head 5.

One end of a return spring 7 is attached to a pin 8 formed on the hand grip 1. The other end of the spring 7 is attached to an attachment hole 9 of the hand lever 2. The return spring 7 returns the hand lever 2 into a rest position when the squeezing of the hand lever 2 is released.

Further, a roller 10 is pivotally secured to the upper front portion of the hand lever 2 and to the right of the pivotal shaft 3 in FIG. 3. A hook 11 to be engaged with the roller 10 is pivotally secured to a pin 12 that carries a spring 13. The engaging portion 11*a* of the hook 11 is detachably fitted to an engaging pin 14 that is bridged between a pair of action arms 19 pivoted to the shaft 3. The engaging portion 11*a* of the hook 11 is urged by the spring 13 to move toward the engaging pin 14, i.e. counterclockwise in the drawings.

To both of the outer sides of the engaging pin 14 are attached a pair of spring supporting members 15 that operate together with the action arms 19. Each spring supporting member 15 is provided with a spring support 17 which supports one end of one of a pair of constant pressure springs 16. The other end of each constant pressure spring 16 is attached to a spring support 18 that is formed in a portion of the yoke arm 4.

The tip ends of the action arms 19 have rocking cams 20. The tip ends are urged counterclockwise about the pivotal shaft 3 by the springs 16. The rocking cams 20 are pivotally secured to the inside walls of the end portions of the action arms 19 by respective cam shafts 21. The cams 20 are urged counterclockwise around shafts 21 by springs 22 that are attached on the cam shafts 21. The counterclockwise most end portion of each cam 20 is brought into contact with a stop pin 24 that is formed on the action arm 19. The rocking cams 20 are further provided with respective contact rollers 23 that are brought into contact with another pair of contact rollers 28 that are respectively attached to a pair of platen arms 25.

The platen arms 25 are disposed at the insides of the rocking cams 20 and are pivotally secured to the shaft 26 of a delivery roller 60 that intermittently advances the tape-like label strip 41. Between the platen arms 25 is fixed a supporting bar 27. The contact rollers 28 are attached to both protruding ends of the supporting bar 27.

Extending in front of the platen arms 25, there is a platen 30 for receiving the label strip 41. The platen 30 is disposed in opposed relation to the type faces 6*a* of the printing head 5. On and just above the surface of the platen 30, a leaf spring 29 is resiliently fitted for supporting the label strip 41.

Platen arms 25 are provided with release springs 32 so as to urge the platen arms 25 counterclockwise about the shaft 26. The coiled portion of each release spring 32 is held by a pin 31 that is fixed to the inside wall of the machine frame 36. One end of the spring 32 is fitted to a stop pin 34 that is also formed on the inside wall of the machine frame. The other end of the release spring 32 is held by a spring support 33 formed on the outside wall of each platen arm 25.

To a portion of the hand lever 2 near the pivotal shaft 3 are attached contact members 35 for receiving the action arms 19.

A label holder 37 is formed on the machine body and its supports a rolled label strip 40, from which the label strip 41 in tape-like form is paid out into the machine body. The label strip 41 is first passed through a label guide (not shown) inside the machine. The label strip is advanced, one label at a time, by a delivery roller 60 by the squeezing operation of the hand lever 2. Then the label strip is moved onto the surface of the platen 30.

The operation of this constant pressure mechanism will be described with reference to FIGS. 3 and 5 to 8.

Figure 5:
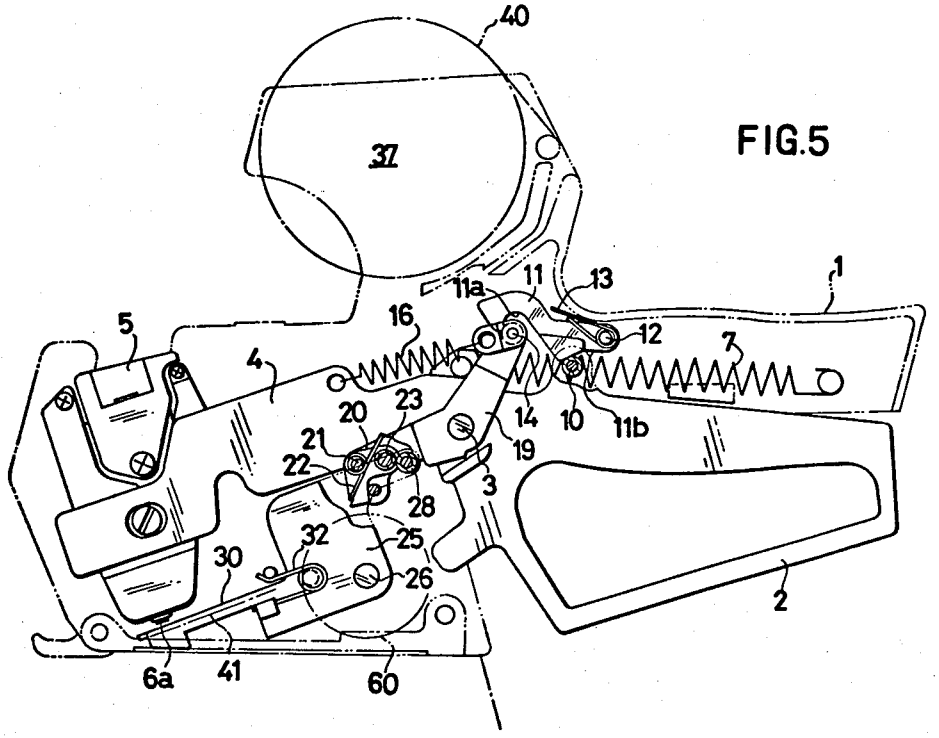

The constant presure mechanism in FIG. 3 is in a rest position. When the hand lever 2 is squeezed, the printing head 5 sweeps through an angular pathway, as shown in FIG. 5. The yoke arms 4 formed in the front portion of the hand lever 2 are turned counterclockwise (downward) about the pivotal shaft 3. In this action, the printing head 5 attached to the yoke arms 4 moves down. In the first half of this downward movement, the type faces 6*a* of the printing head 5 are applied with ink by an inking roller (of the type described below, for example), which moves over the type faces as the printing head descends. Thus, the printing head 5 is in the condition in which printing is possible.

As it is squeezed, the hand lever 2 turns about the pivotal shaft 3 against the force of the return spring 7 and the constant pressure springs 16, which springs 7 and 16 are energized. When the hand lever 2 is further squeezed, the roller 10 of the hand lever 2 comes into contact with the engaging face 11*b* of the hook 11 and rotates the hook 11 clockwise about the pin 12. This raises the engaging portion 11*a* at the free end of the hook 11. Accordingly, the previous engagement between the engaging portion 11*a* and the engaging pin 14 (FIG. 3) is released against the force of the spring 13 (see FIG. 5).

The state shown in FIG. 5 is at the moment just before the above described disengagement, and the angle of rotation of the hand lever 2 in this embodiment is about 17°30′.

Figure 6:
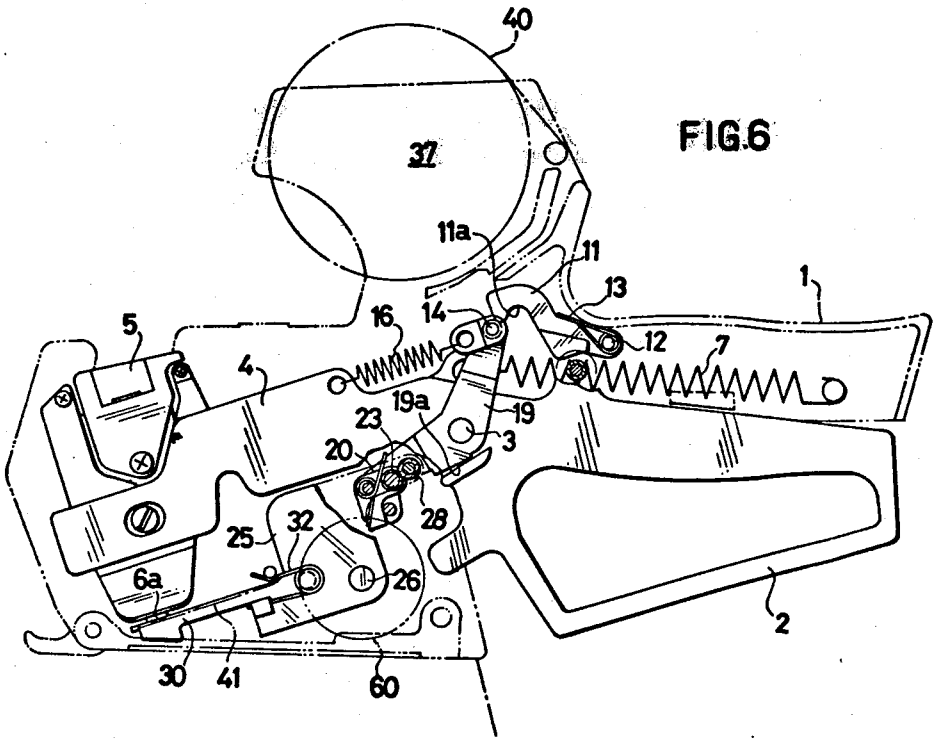

When the hand lever 2 is further squeezed to have rotated 18°, the mechanism shifts to the printing position shown in FIG. 6. The engagement between the hook 11 and the engaging pin 14 is released. This releases the charged constant pressure springs 16 so that the engaging pin 14 is shifted to the left in FIG. 6 toward the tip ends of the yoke arms 4 by the stored energy in the springs 16. The action arms 19 carrying the engaging pin 14 are rotated counterclockwise about the pivotal shaft 3. The contact rollers 23 of the rocking cams 20, which are attached to the free ends of the action arms 19, momentarily strike the contact rollers 28 of the platen arms 25.

Due to this impact of momentary engagement of the rollers 23, 28, the platen arms 25 are rotated clockwise about the shaft 26 against the force of release springs 32, and the label surface of the label of strip 41 then on the platen 30 is brought into contact with the type faces 6*a* of the printing head 5 and the label is printed.

Figure 7:
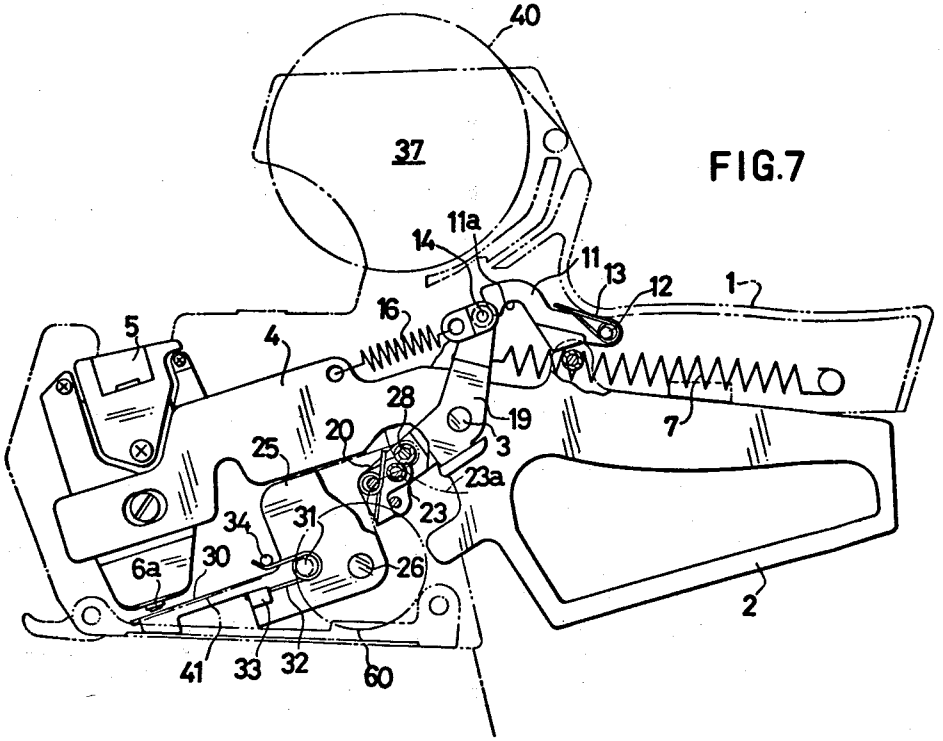

As shown in FIG. 7, immediately after the printing of a label, the platen 30 is slightly away from the type faces 6*a* of the printing head 5. After the above described contact of the type faces 6*a* of the printing head 5 with the platen 30, the platen 30 is pushed away from the type faces 6*a* by the release springs 32 of the platen arms 25. In this action, the contact rollers 28 are moved above the contact rollers 23 of the rocking cams 20 attached to action arms 19 and the rollers 28 are positioned outside the loci 23*a* of the peripheral surfaces of other contact rollers 23.

Figure 8:
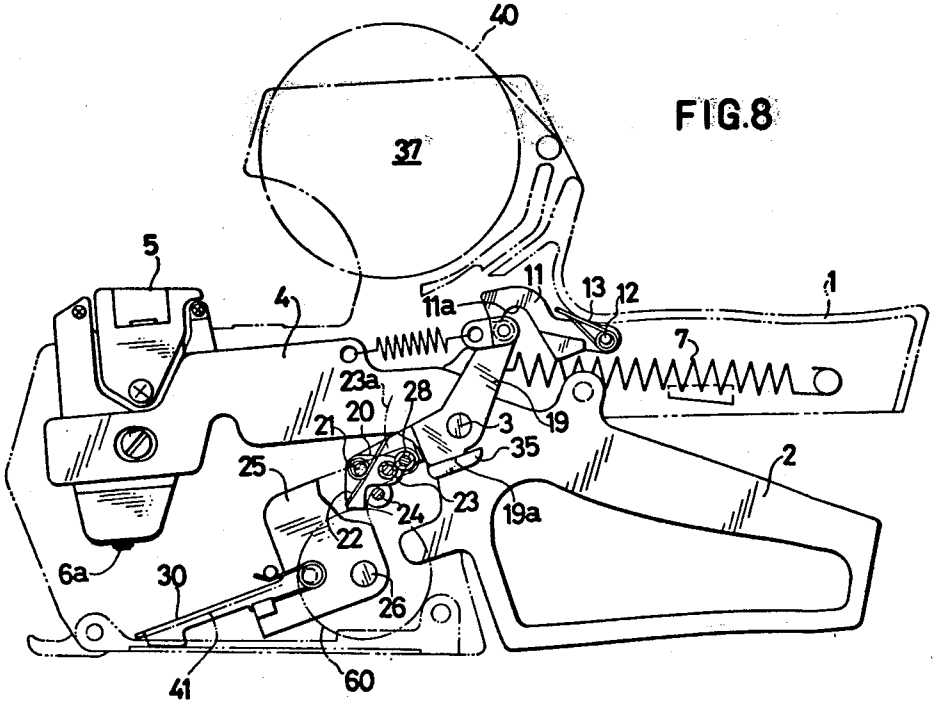

When the hand lever 2 is then released, the yoke arms 4 pivot clockwise under the rebound force of the return spring 7 and arms 4 return to the rest position of FIG. 3, passing through the position of FIG. 8. With the printing head 5 returned to its original position, the constant pressure printing is completed.

During the return of the yoke arms 4 with the printing head 5, the action arms 19 are also returned clockwise together with the yoke arms 4 because the contact members 35 formed on the hand lever 2 pivot with the hand lever and into contact with the contact faces 19*a* of the action arms 19 (see FIGS. 5–7). In order to return the action arms 19 smoothly during the above described motion, it is necessary to turn away the rocking cams 20 of the action arms 19 slightly. The contact rollers 23 of the rocking cams 20 move along their loci 23*a* so that these rocking cams 20 are turned by being pushed by the contact rollers 28 of the platen arms 25. The rocking cams 20 are turned clockwise about the cam shaft 21 against the force of the springs 22, while the action arms 19 are smoothly turned back. These rocking cams 20 that have been turned during the returning motion of the action arms 19 are soon returned counterclockwise by the force of the spring 22 until the cams 20 are again stopped by the stop pins 24.

The second embodiment of the constant pressure mechanism is now described with reference to FIGS. 9 to 12.

Figure 9:
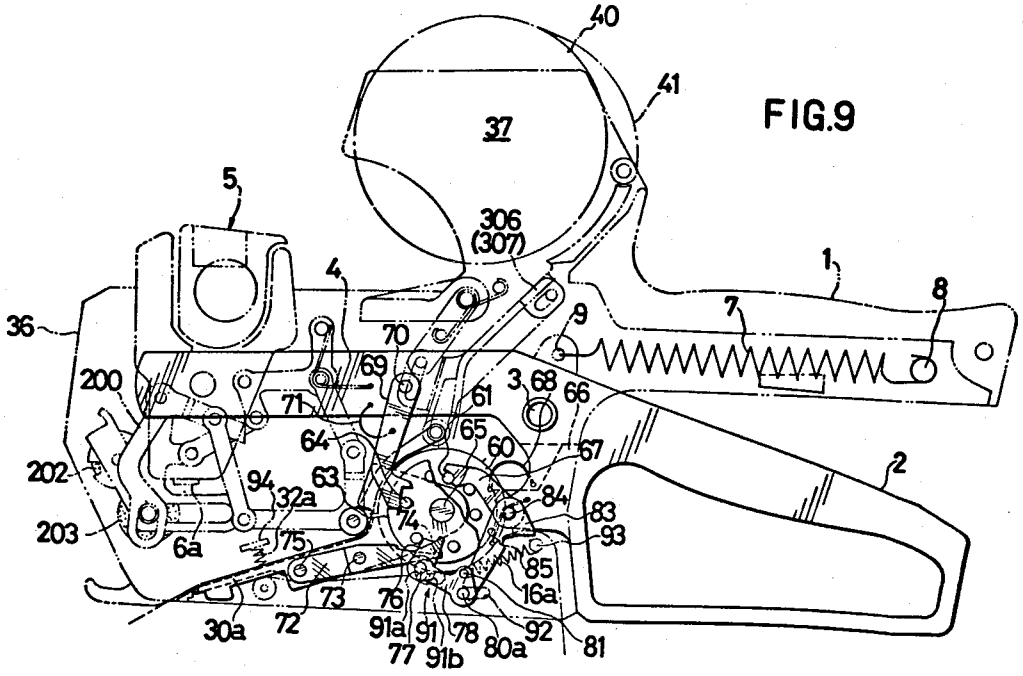
Figure 10:
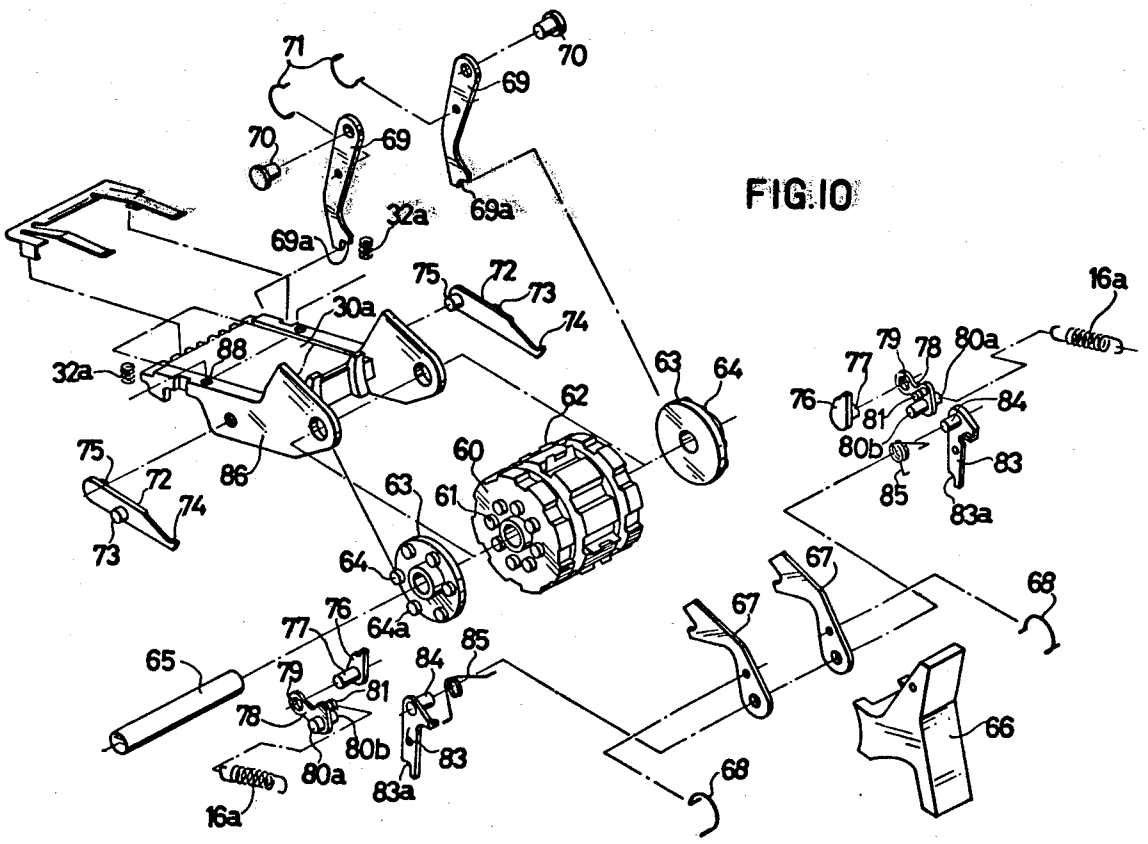

As shown in FIGS. 9 and 10 particularly, a hand lever 2 is moved back and forth relatively to the hand grip 1 about the pivotal shaft 3. The front portion of the hand lever 2 is provided with bifurcated yoke arms 4 and a printing head 5 is attached to the yoke arms 4. The printing head 5 has a plurality of stamp belts arrayed side by side and the type faces 6*a* of the stamp belts are disposed outside on the under surface of the printing head 5.

Further, the mechanism is provided with a return spring 7 for returning the hand lever 2 to the rest position when it is released. One end of the return spring 7 is attached to a pin 8 formed on the hand grip 1 and the other end of the return spring 7 is hooked into the attachment hole 9 formed in the front portion of the hand lever 2.

To a shaft 65 that is fitted between the pair of external labeling machine frames 36, there is attached a delivery roller 60 which intermittently shifts the tape-like label strip 41 by one label length at a time. A plurality of projections 62 for label strip transferring are formed on the circumferential surface of the delivery roller 60. Eight feed pins 61 are formed on each side wall of the roller 60 at regular intervals.

There are separate rotary discs 63 forming a part of the constant pressure mechanism and placed on both sides of the delivery roller 60. The roller 60 and the discs 63 may be rotated separately. Further, six pins 64 are disposed at regular intervals on the outside side wall of each rotary disc 63.

First pushing pawls 69, which are pivotally secured to the yoke arms 4 by respective pins 70, are brought into detachable engagement with the side wall pins 64 on the rotary discs 63. At the same time, the pawl tips 69*a* of the first pushing pawls 69 are urged toward the pin 64 by a spring 71.

The pins 61 on the delivery roller 60 are detachably engaged by delivery pawls 67 that are indirectly pivotally attached to the hand lever 2. As will later be explained in more detail, the delivery pawls 67 and second pushing pawls 83 are pivotally secured to a carrier 66 formed at the front of the hand lever 2. The upper tip ends of the pawls 67 are urged toward the pins 61 by the springs 68.

The platen 30*a* having a pair of arm members 86 is pivotally secured to the shaft 65 of the rotary discs 63 and the delivery roller 60. In the recesses 88 formed in the upper surfaces of the arm members 86 are fitted release springs 32*a*. The upper ends of the release springs 32*a* are depressed by contact pieces 94 that are formed on the side walls of machine frames 36 so that, in its rest position, the platen 30*a* is depressed to the bottom portions of the machine frames 36 by the rebound force of the release springs 32*a*.

A pair of action levers 72 are pivotally secured to the platen 30*a* with respective pins 75. The action levers 72 are, in turn, pivotally secured to the machine frames 36 by their pivot pins 73. At the rear, right hand ends of the levers 72 (see FIG. 10), projections 74 are formed to be engaged with the pins 64*a* formed on the sides of the rotary discs 63.

Further, the rotary discs 63 are provided with action members each comprising a delivery pawl 76 and an engaging link 78 having a constant pressure spring 16*a*. The delivery pawls 76 are brought into pressure contact with the pins 64 of the rotary discs 63 so as to push the pins 64 and the discs 63 clockwise in FIGS. 9 and 10. The pivot pins 77 of the pawls 76 are inserted into the fitting holes 79 of the engaging links 78, respectively, and are further slidably fitted into L-shaped engaging grooves 91 that are defined in the walls of the machine frames 36. The vertical portion of each engaging groove 91 forms a stopping section 91*a* for the delivery pawl 76 and the horizontal portion thereof forms a sliding section 91*b* for the same pawl 76.

Both the inner and outer sides of each engaging link 78 are provided with projecting pins, where the outer pin 80*a* is brought into engagement with a guide groove 92 defined in the machine frame 36, while the inner pin 80*b* is resiliently fitted to the pawl tip 83*a* of a second pushing pawl 83. The second pushing pawls 83 and the delivery pawls 67 are pivotally secured to the carrier 66 by the respective pivot pins 84. With the springs 85 fitted to the pivot pins 84, the pawl tips 83*a* of the second pushing pawls 83 are urged against the inner pins 80*b* of the engaging links 78. The engaging links 78 are further provided with respective spring studs 81 and constant pressure springs 16*a* are stretched between the spring studs 81 and other spring studs 93 that are formed on the walls of the machine frames 36, which pivots the links 78 clockwise.

The operation of this embodiment of constant pressure mechanism is now described.

Figure 11:
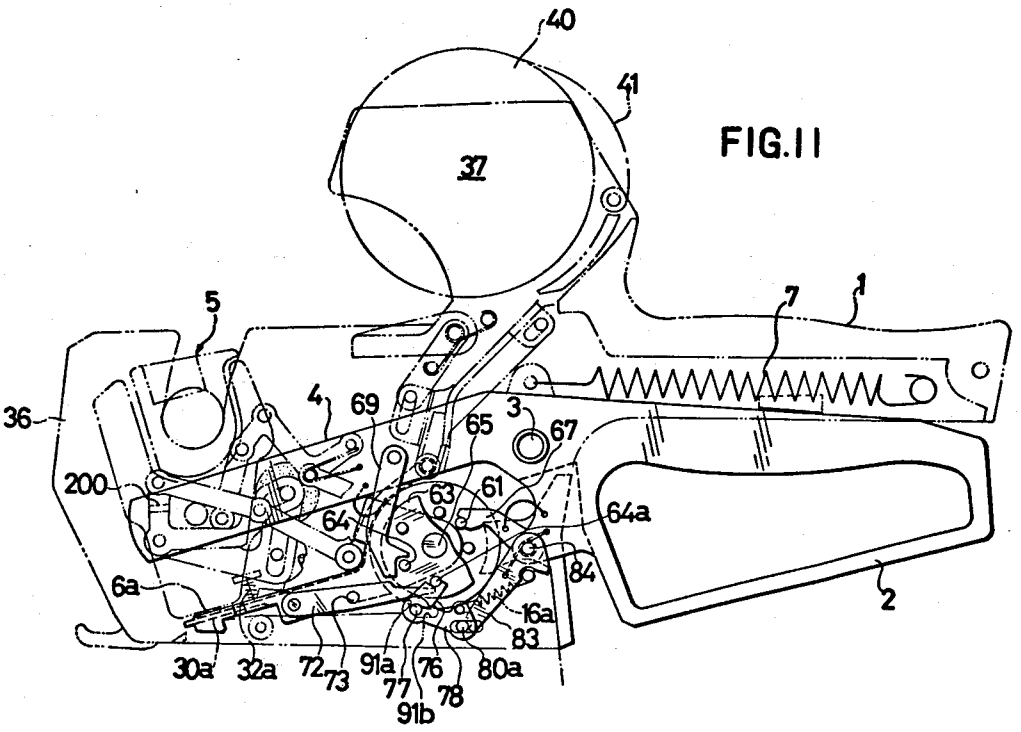

The printing head 5 and the platen 30*a* are firstly shifted into the printing position of FIG. 11 from the rest position of FIG. 9. When the hand lever 2 is squeezed, the yoke arms 4 are pivoted counter-clockwise and down about the fulcrum of the pivotal shaft 3 and against the tension of the return spring 7. The printing head 5 moves down together with the yoke arms 4. During this movement, the type faces 6*a* are applied with ink by the first and second inking rollers 202 and 203 of an inking device that comprises multi-link mechanism connected to the yoke arms 4. This inking device may be of any known type which operates upon movement of a print head relative to the inking device.

When the hand lever 2 is first turned through one angle (17°30′) and later to the final angle (18°), the descent of the printing head 5 and the rise of the platen 30*a* occur in the same sequence as in the first embodiment. The pawl tips 69*a* of the first pushing pawls 69 descend together with the yoke arms 4 and contact the pins 64 of the rotary discs 63, rotating the discs 63 counterclockwise.

This rotation of the pin 64*a* in the lower portion of each rotary disc 63 pushes and turns clockwise only the delivery pawl 76 without contacting the action lever 72. Once the upper portion of pawl 76 is engaged by pin 64*a*, the delivery pawl 76 is pushed down until the pivot pin 77 of the pawl 76 is shifted to the lower end portion of the stopping section 91*a* of engaging groove 91, at which the hand lever 2 has been squeezed through an angle of about 17°30′.

When the hand lever 2 is further squeezed slightly through the squeezing angle of 18°, the delivery pawl 76 is pushed further down by the movement of the pin 64*a*, and the pivot pin 77 of the pawl 76 is then moved into the horizontal sliding section 91*b* of the engaging groove 91. At this moment, the delivery pawl 76 is pulled rearward (to the right in FIG. 12) along with the engaging link 78 by the tension energy of the constant pressure spring 16*a*, and pawl 76 is pulled together with the pin 64*a* in pressure contact.

During this movement, the pin 64*a* is moved along a counterclockwise pathway by the tension of the constant pressure spring 16*a*. The projection 74 of the action lever 72 is disposed inside that pathway so that the projection 74 is pushed down by the moving pin 64*a*. When the projection 74 of the action lever 72 is pushed down, the action lever 72 is turned clockwise about the pivot pin 73. The platen 30*a* connected with the lever 72 is thus turned up about the pivotal shaft 65 against the type faces 6*a* of the descending printing head 5. Accordingly, the tape-like label strip 41 that is carried on the platen 30*a* is printed with a constant printing pressure.

Figure 12:
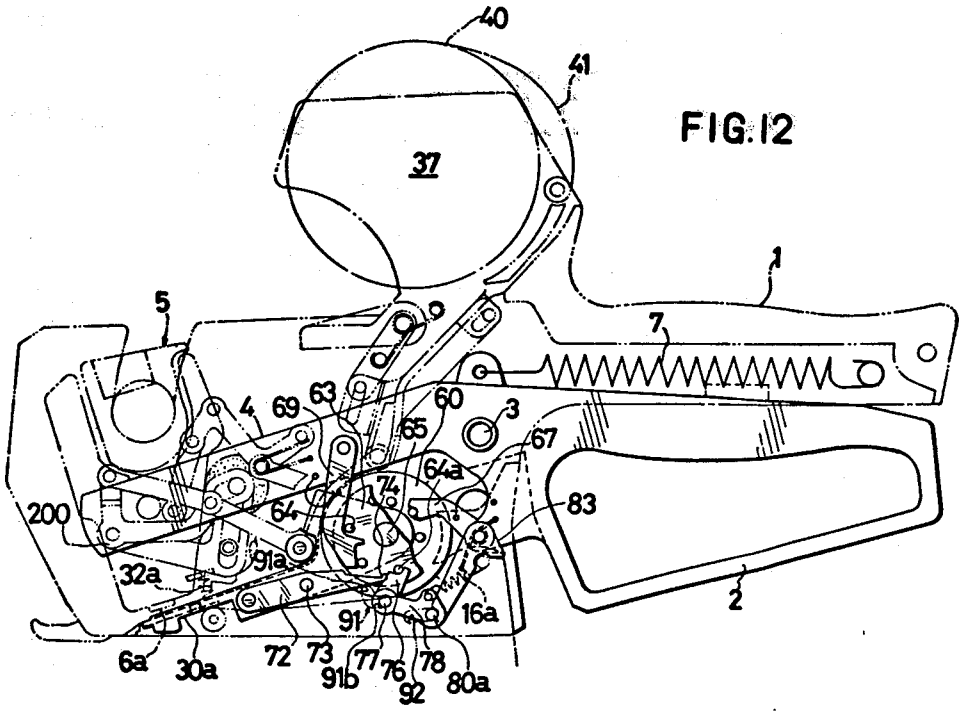
Figure 13:
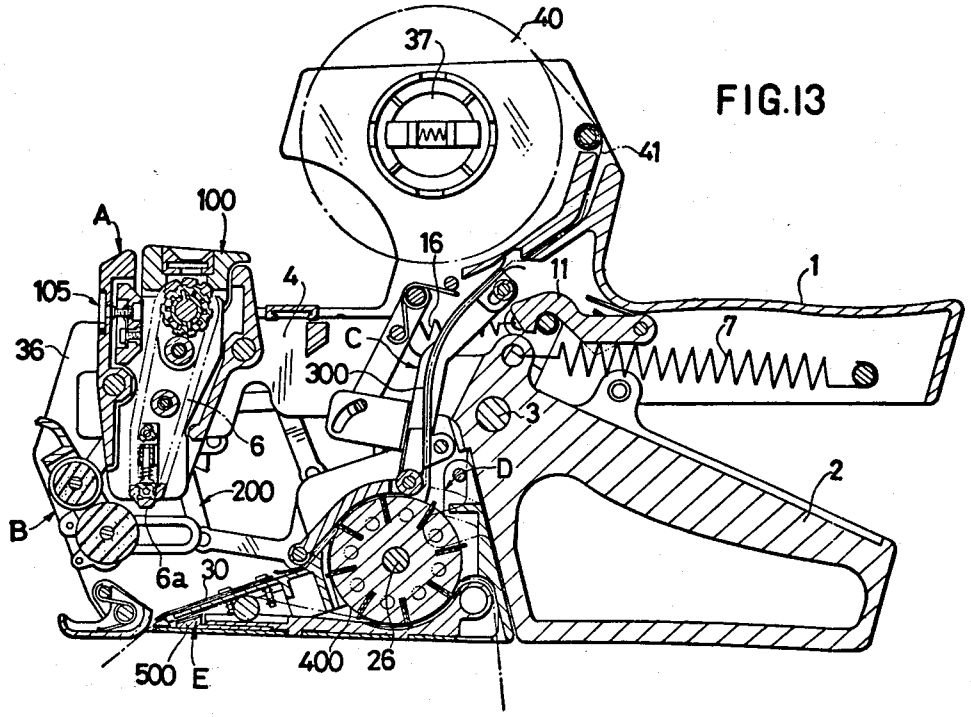

Immediately after the printing stroke, the platen 30*a* is pushed down from the printing position, as shown in FIG. 12. As the pin 64*a* is rotated by the constant pressure spring 16*a*, it passes beyond the apex of the projection 74 toward its rear side (counterclockwise) and in so moving, the pin 64*a* depresses the projection 74 of the action lever 72.

The action lever 72 is freed by such passage of pin 64*a* so that the platen 30*a* is moved back from the printing position to the lower rest position by the rebound force of the release spring 32*a*. In this action, the engaging link 78 is pulled rearward toward the hand lever 2 by the tension energy of the constant pressure spring 16*a*, in which the outer pin 80*a* is guided by the guide groove 92 and the pivot pin 77 of the delivery pawl 76 is guided by the sliding section 91*b* of the engaging groove 91.

When the hand lever 2 is released, the mechanism is returned to its original state of FIG. 9 from its condition of FIG. 12 by the rebound force of the return spring 7. During this returning movement, the first pushing pawls 69 are pulled up by the yokes 4. The delivery pawls 76 and the engaging links 78 ae pushed to their original positions by the second pushing pawls 83. The second pushing pawls 83 are pushed forth (to the side of platen 30*a*) by the squeezing of hand lever 2, so that the inner pins 80*a* of the engaging links 78 are moved forward along the guide grooves 92. With this forward movement, the pivot pins 77 of the delivery pawls 76 are moved into the stopping sections 91*a* of the engaging grooves 91, thereby completing the constant pressure printing operation.

Meanwhile, before each constant pressure printing stroke, the tape-like label strip 41 is supplied from the rolled label strip 40 to the surface of the platen 30*a* through label guide plates 306 and 307 and the delivery roller 60, as in the first embodiment. The advancing of the tape-like label strip 41 is performed during the releasing of the hand lever 2. The pins 61 of the delivery roller 60 are pushed forward counterclockwise by the engagement with the delivery pawls 67 so that the delivery roller 60 is intermittently rotated when the hand lever 2 is released.

As disclosed above, the constant pressure mechanism of the present invention has the following advantages:

(1) Since the mechanism is provided with a constant pressure means to turn up the platen toward the type faces of the printing head with a constant pressure in synchronism with the downward movement of the printing head, a constant printing pressure can always be exerted, irrespective of the strength of squeezing of the hand lever. This is quite advantageous when the mechanism is used in a portable label printing and applying machine for a POS (point of sales) system employing optical character readers, because highly precise printing can be attained.

(2) Since the mechanism is provided with a means to separate the platen slightly from the printing position just after the printing action between the printing head and the platen, the type faces are not held in contact with the printed label for a long time and excess absorption or blurring of ink on the label surface can be prevented.

Angle Adjusting Device for Type Faces

As described above, the fulcrums or pivots of the movements of the opposed printing head and platen are separated and printing is performed by turning the printing head and the platen. The starting time of platen motion and the rate of interaction between the printing head and the platen are liable to vary over time in use. The position of contact between the printing head and the platen, i.e. the printing position, is gradually changed. As a result, the type faces of the printing head are no longer parallel to the surface of the platen when they come into contact, so that the depths and darkness at different sides of the figures that are printed on a label becomes different from each other.

To correct this, the angle of the type faces is adjusted by turning the printing head with the angle adjusting device A so that the type faces of the printing head can be parallel to the surface of the platen when they strike the label so as to attain precise printing with imprints of uniform darkness.

Figure 20:
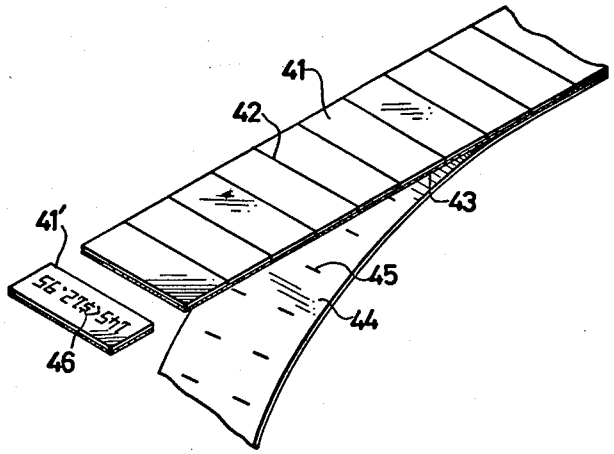
Figure 21:
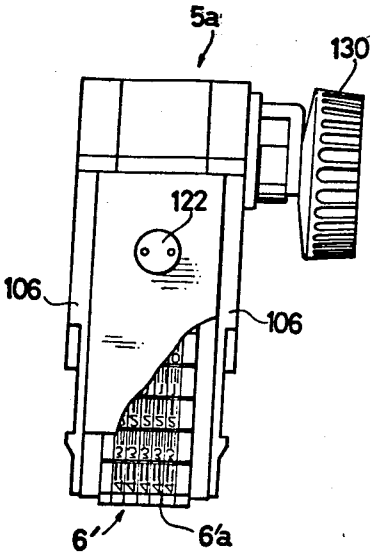
Figure 22:
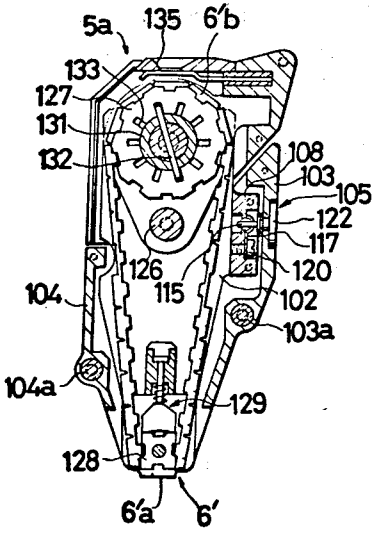
Figures 23, 24, 25, 26:
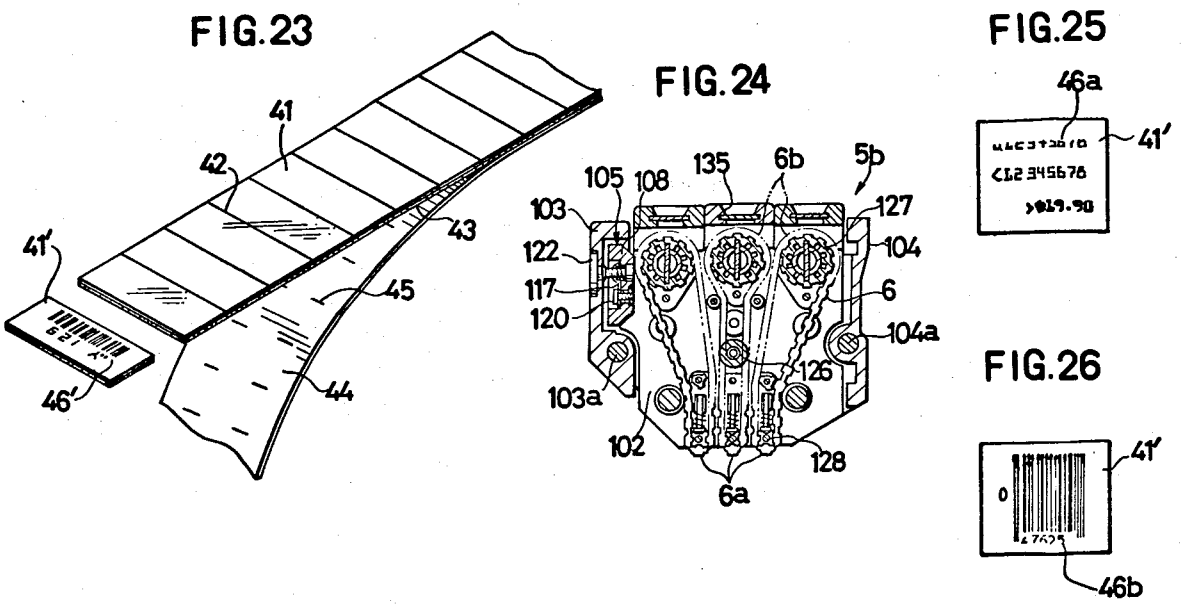

A first embodiment of angle adjusting device is shown in FIGS. 14 to 20, a second embodiment is shown, in FIGS. 21 to 23, and a third embodiment is shown in FIGS. 24 to 26.

The first embodiment will be described as a basic device.

Figure 15:
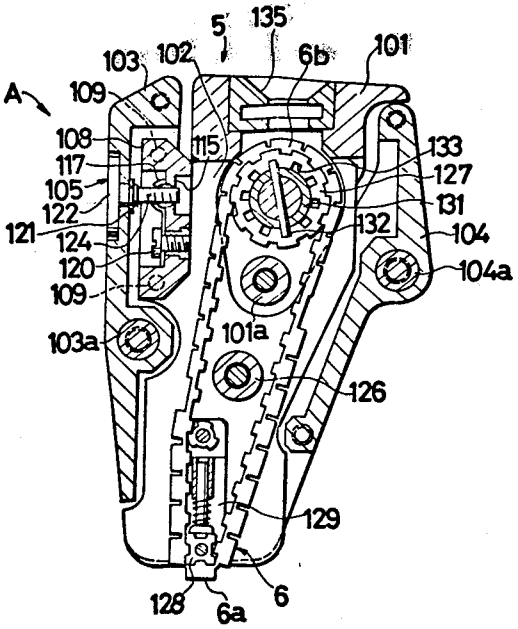
Figure 14:
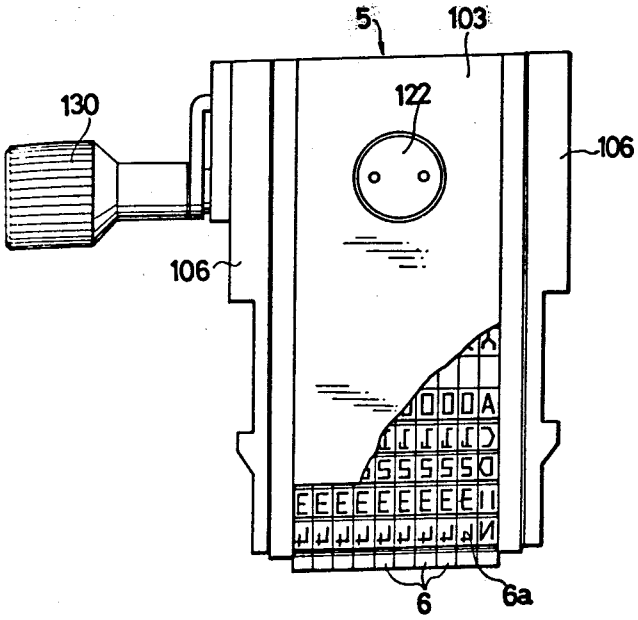
Figure 16:
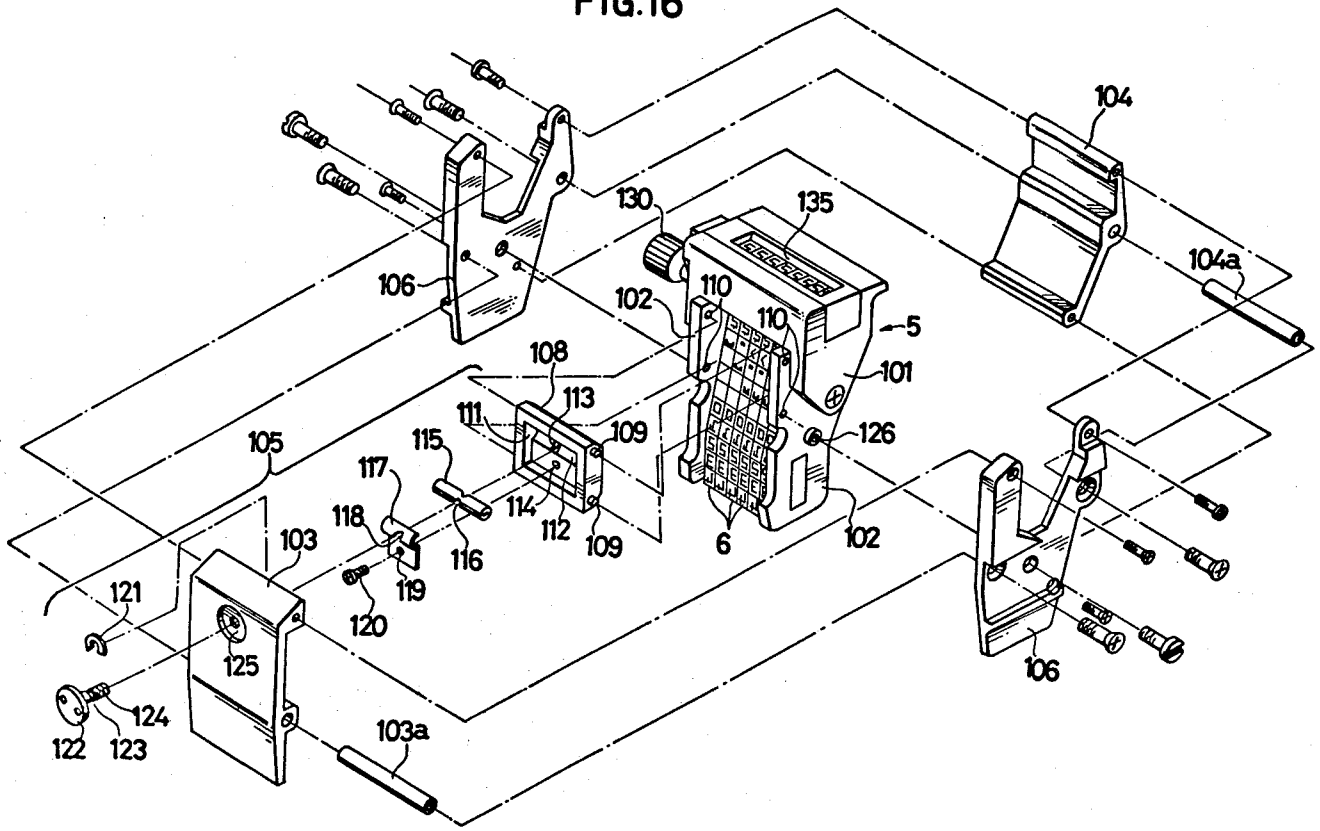

The printing head 5 is attached near the free ends of a pair of yoke arms 4 that are interlocked with the hand lever 2. As shown in FIGS. 15 and 16, the printing head 5 is comprised of its main parts, including a casing 101, a pair of frames 102 that are fixed to the casing 101 by spindles 101*a*, a front cover 103, a rear cover 104, an angle adjusting section 105 that is disposed in the space between the frames 102 and the front cover 103, side walls 106 which are attached to the pair of yoke arms 4 of the label printing machine, and a plurality of stamp belts 6 that are arrayed side by side in the space formed by the casing 101 and the frames 103 and the stamp belts being provided with type faces carrying numerals, symbols, marks or other characters. The front cover 103 is attached to both of the side walls 106 with a shaft 103*a*. The rear cover 104 is also fixed to the side walls 106 with a shaft 104*a*.

The angle adjusting section 105 comprises an adjusting member 108, a supporting member 115, a fixing piece 117, a snap 121, and an adjusting screw 122.

The fixing pins 109 formed on both side walls of the adjusting member 108 are inserted into the fixing holes 110 that are defined in the inner walls of the pair of frames 102, thereby fitting the adjusting member 108 to both frames 102. In the front wall of the adjusting member 108, a depression 111 is formed. A cross-sectionally arcuate depression 112 having a fixing hole 113 is formed within the above depression 111. A rod-shaped supporting member 115 is disposed in the arcuate depression 112. Member 115 has a screw hole 116 that extends perpendicular to the axis of the supporting member 115. The rounded fixing piece 117 having a through hole 118 is fitted to the supporting member 115. The fixing piece 117 is attached by a screw 120 inserted into a fixing hole 119 that is formed in a downwardly extending supporting portion of the fixing piece 117. The screw 120 extends into the screw hole 114 in the depression 111 of the above adjusting member 108.

An adjusting screw 122 is disposed in the circular depression 125 of the front cover 103. The front cover 103 and the fixing piece 117 are fastened to the supporting member 115 that is attached to the adjusting member 108, by the screw threads 124 of the adjusting screw 122. At the same time, the front cover 103 is securely engaged by the inside wall of the screw head of adjusting screw 122 and by a snap fit of the cover 103 that is fitted to a circular groove 123.

Between both side frames 102, a pivot shaft 126 is attached for the angle adjustment of a group of stamp belts 6, so that both of the frames 102 can be freely rocked. A plurality of stamp belts 6 are arranged in the casing 101 and are wrapped around a corresponding plurality of selecting wheels 127 which are arranged side-by-side and around a corresponding plurality of positioning members 128 which are also arranged side-by-side. The wheels 127 and members 128 are pivotally secured between the frames 102. The members 128 are provided with resilient supporting devices 129. Each selecting wheel 127 is provided with internal gear teeth 133, to which an engaging piece 132 is engaged. The engaging piece 132 is attached to the selecting shaft 131 and the shaft has a rotary knob 130 at one side end. Thus, a chosen stamp belt selecting wheel 127 can be rotated.

Figure 17:
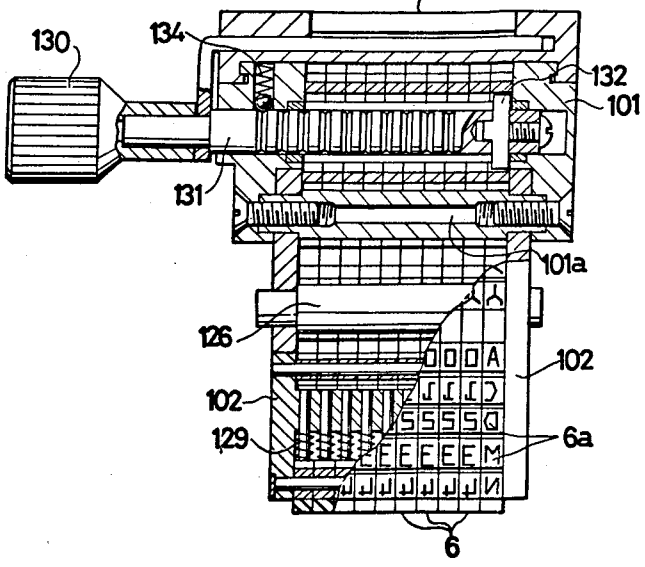

As shown in FIG. 17, a stamp belt setting means 134 is resiliently pressed against the selecting shaft 131 for setting the position of the selecting wheel 127. When the selecting wheel 127 for a desired stamp belt is rotated by means of the knob 130, the respective stamp belt 6 is moved around. The endless stamp belt 6 has a plurality of type faces 6*a* on the exterior sides of one half of the belt, and the other half of the belt has its exterior sides provided with indication figures 6*b*. These indication figures 6*b* can be observed through a window 135 that is formed in the upper part of the casing 101.

Figure 18:
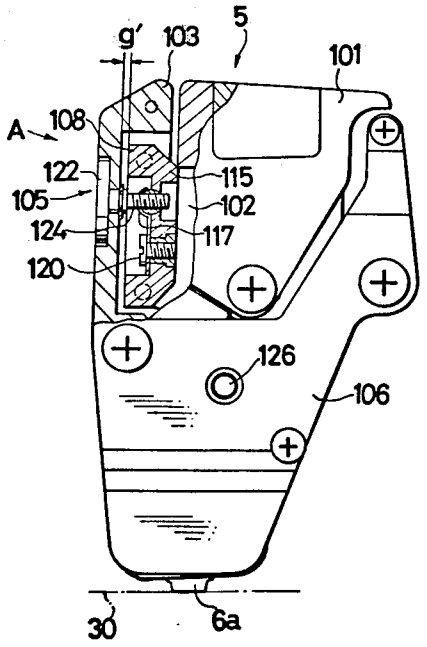
Figure 19:
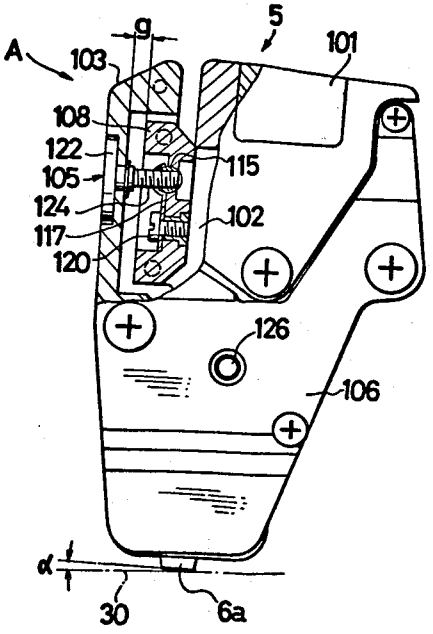

FIGS. 18 and 19 show angle adjustment for type faces. The state before angle adjustment is shown in FIG. 19. Here the type faces 6*a* of stamp belt 6 in the printing head 5 are contacting the surface of platen 30 at an inclination angle of $\alpha$. Printing with the printing machine in this state causes the inking at the upper sides of printed figures 46 on a label 41' (FIG. 20) to be thin.

The orientation of the type faces 6*a* is adjusted by using an angle adjusting section 105 that is provided in the printing head 5. By turning the adjusting screw 122 clockwise with a tool, the screw threads 124 in the screw hole 116 of the supporting member 115 that is fixed to the adjusting member 108, are moved forward or deeper. The supporting member 115 and the adjusting member 108 are pulled toward the front cover 103. With this action, the gap g between the front cover 103 and the adjusting member 108 (FIG. 19) is narrowed to the gap g' (FIG. 18), and both of the frames 102 carrying the stamp belts 6 are turned slightly counterclockwsie about the pivot shaft 126. Accordingly, the above inclination angle $\alpha$ can be eliminated, and the type faces 6a and the surface of the platen 30 are again made parallel to each other.

In FIG. 20, a tape-like label strip 41, which has an adhesive layer 43 on its rear side is the surface imprinted by the printing type faces 6a. Between the labels 41 are formed the cutting lines 42. The labels are on a tape-like backing strip that carries the label strip 41. The backing strip has perforations 45 by which the label strip assembly is shifted.

The second embodiment of the angle adjustment device is shown in FIGS. 21 to 23. The printing head 5a in this embodiment is almost the same as in the foregoing embodiment, except for the stamp belts 6'. Each stamp belt 6' is provided with type faces 6'a for printing both bar codes and numerical figures 46' which are used for printing prices or the like and indication figures 6'b corresponding to the type faces 6'a. Since the angle adjusting section 105 as the main component part has the same structure and is operated in the same manner, the detailed description of this embodiment is omitted.

The third embodiment of an angle adjusting device is shown in FIG. 24. It relates to a three-line printing head 5b that carries three sets of stamp belt groups 6 between both side frames 102. The head 5b has a pivot shaft 126. The printing head 5b is provided with the same angle adjusting device 105 as that of the first embodiment. The structure and operation of the angle adjusting device 105 of this embodiment is the same as those of the first embodiment. Thus, the description of the device 105 of this embodiment is also omitted.

In FIG. 25, a label that has been printed with the three-line printing head 5b is shown. FIGS. 46a for optical character readers are printed in three lines. The FIGS. 46a have been printed with a printing head 5a which is incomplete in its angle adjustment, so that the upper parts of the figures on the upper line are not printed well. In FIG. 26, incomplete printing of bar codes 46b is shown, in which the lower ends of bar codes and the checking figures are printed unsatisfactorily. Labels in the states of printing of FIGS. 25 and 26 cannot be used because optical reading and even visual reading are impossible or nearly so. The angle adjusting device of the present invention has an excellent effect in multi-line or large figure printing on labels such as three-line printing and bar code printing for the application of optical reading facilities.

Inking Device

The inking device B comprises a multi-link mechanism having inking rollers that apply ink to the type faces of a printing head in interlocked movement with the squeezing of a hand lever.

This inking device has the following characteristic features:

(1) The force necessary for squeezing the hand lever is reduced while the pressure of inking rollers on the type faces is always proper and constant for constantly applying a uniform quantity of ink. Accordingly, high precision printing at constant darkness can be attained for a large number of labels in long time use.

(2) With the squeezing of the hand lever, the inking rollers that are carried by multi-link mechanism are held inside of the label printing machine. This is to be contrasted with the conventional labeling machines having protruded inking rollers, whereby an unobstructed view of the label applying work is aided.

(3) Since the inking rollers are moved into the machine body by the squeezing of the hand lever, useless spaces in the machine body are reduced so that the label printing machine can be made compact and handy.

The inking device will be described with reference to FIGS. 27 to 31, and particularly FIGS. 27 and 28. The multi-link mechanism 200 is operatively joined to the printing head 5 that is attached to the tip end portions of the pair of yoke arms 4 that extend forward from the hand lever 2. Mechanism 200 is provided with three pairs of fixed pivots, that is, a pair of fixed pivots 204 consisting of pivotal shafts secured to the machine frames 36 and two pairs of fixed pivots 205 and 206 that are pivotally secured rearwardly and forwardly, respectively, on the yoke arms 4. Further, the mechanism 200 has a plurality of other movable fulcrums, described below.

Since the structure and operation on one side of the multi-link mechanism 200 are symmetrical to those on the other side, only the links on the side shown in the drawings will be described.

To the fixed fulcrum 205 that is attached to a yoke arm 4 on one side, a generally S-shaped operative link 207 and a connecting link 215 are pivotally secured. The operative link 207 is provided with a contact pin 208 on the outside, a stop lug 209 also on the outside, an engaging lug 210 on the inside, and a spring pin 211 also on the inside. The operative link 207 is urged counterclockwise (in the direction to push down) about the fixed fulcrum 205 by a spring 212 that is carried by a supporting pin 213 on the yoke arm 4. One end of the spring 212 is fitted to the spring pin 211 of the operative link 207 and the other end of spring 212 is fitted to a spring pin 214 formed on the side wall of the yoke arm 4.

At the other fixed pivot 206, there is pivotally secured to the yoke arm 4, a guide link 227 having a generally F-shape and a rocking link 221 having a generally L-shape.

The guide link 227 has a slot 228 along its end cross arm and a movable pivot 229 at its middle cross arm so as to pivot an I-shaped operative link 230. The frame 201 of a pair of large and small inking rollers 202 and 203 is guided in the slot 228. The operative link 230 is joined to the operative link 207 at a pivot 231, and the link 230 can be engaged with the engaging lug 210 of the link 207. In the rest position, the operative link 230 is pressed to the engaging lug 210 by the force of the spring 212 of the operative link 207. In other words, the movable pivot 231 between both the operative links 207 and 230, the fixed pivot 205 of the operative link 207, and the movable pivot 229 of the guide link 227 are positioned on a line.

A slot 223 is formed at one end portion of the rocking link 221 for moving the frame 201 of inking rollers. The other end portion of the rocking link 221 has a push-up portion 222 that is brought into contact with the contact pin 208 of the operative link 207. Near the push-up portion 222, there is a movable pivot 220 that is connected to an action link 216 through a connecting link 219.

The action link 216 is pivotally secured to a machine frame 36 at pivot 204. One end of the link 216 is connected to the connecting link 215 at the pivot 217, while the other end of the link 216 is connected to the connecting link 219 at the pivot 218. Accordingly, the rocking link 221 is rocked by the other end of the action link 216 through the connecting link 219.

A roller that is carried by a supporting shaft 234 formed on a supporting member 236 is slidably fitted into the slot 223 of the rocking link 221 and the slot 228 of the guide link 227. This supporting member 236 supports the inking roller frame 201. On the outside of the supporting shaft 234, a supporting piece 232 having a stop pin 233 is attached. Thus, the guide link 227 and the rocking link 221 are held between the supporting piece 232 and the supporting member 236.

A spring 225 is supported by the supporting shaft 234. One end of the spring 225 is fitted into the spring hole 237 of the supporting member 236 and the other end of the spring 225 is fitted to a spring pin 224 that is formed on the rocking link 221, whereby spring 225 urges the supporting member 236 clockwise about the supporting shaft 234. The turning of the supporting piece 232 is stopped by contact between its stop pin 233 and the rocking link 221.

The supporting member 236 is attached to the front portion of each of the two symmetric multi-link mechanisms. On the inside of the supporting member 236, a fitting section 238 having front and rear engaging grooves 239 is formed. The inking roller frame 201 can be detachably secured to both supporting members 236 by fitting the engaging pieces 235 of the frame 201 into the engaging grooves 239 of both fitting sections 238.

The operation of the inking device is now described with reference to FIGS. 27 and 29 to 32.

Figure 27:
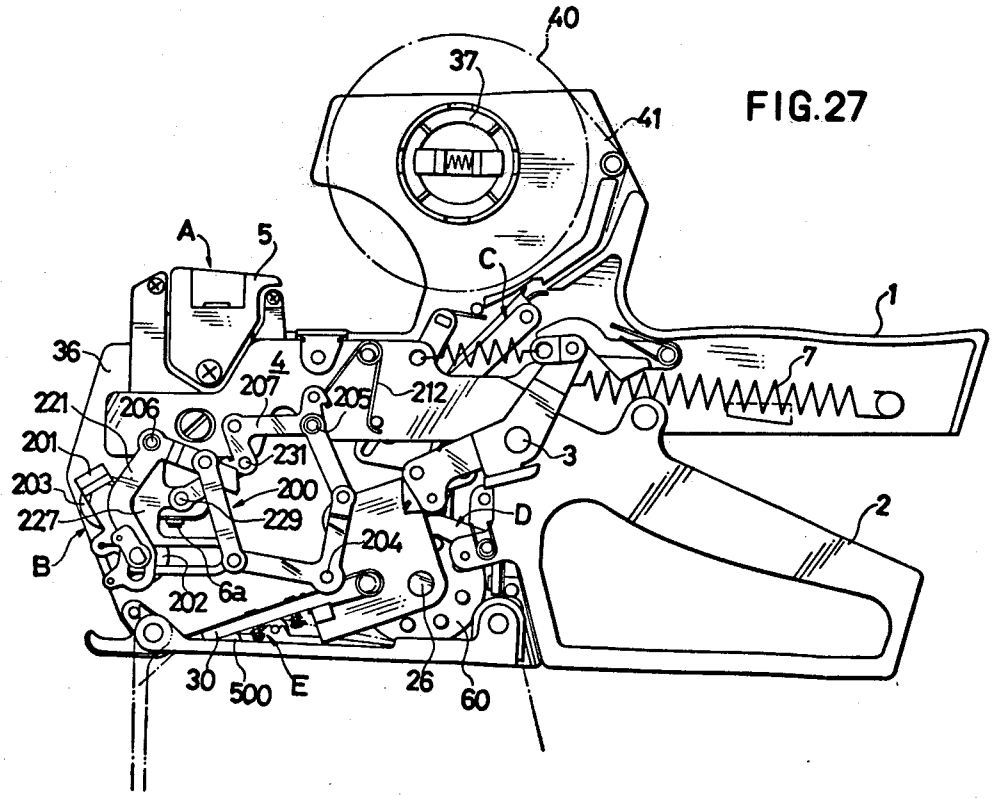
Figure 28:
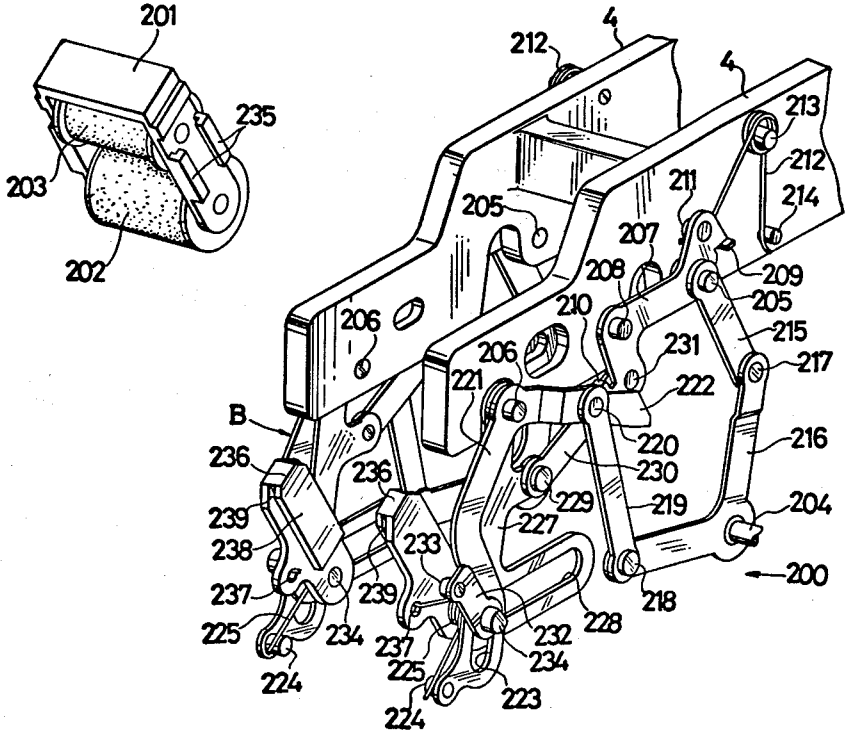
Figure 29:
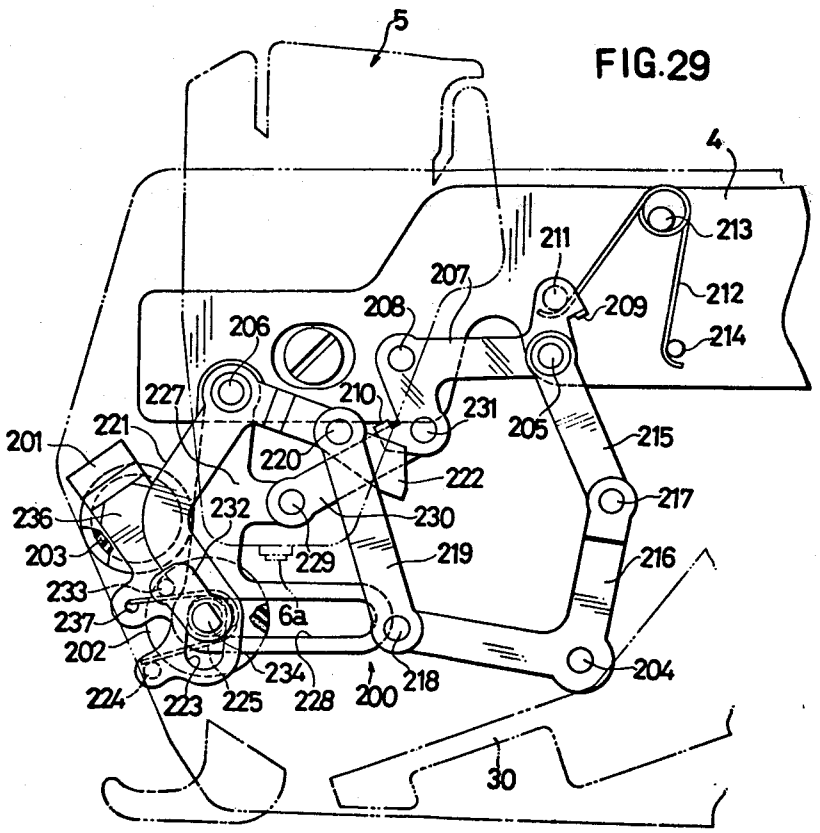
Figure 30:
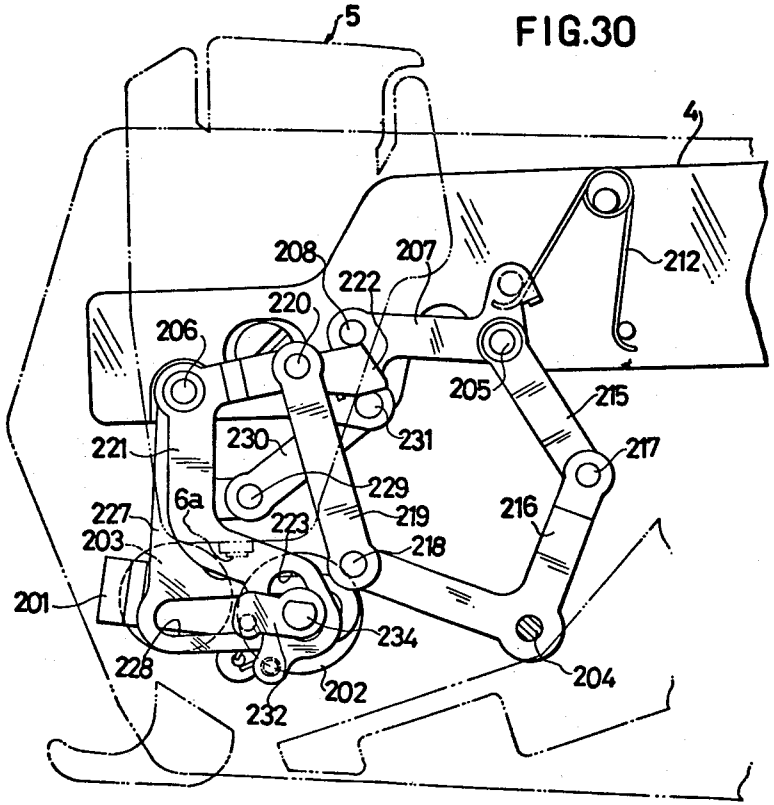
Figure 31:
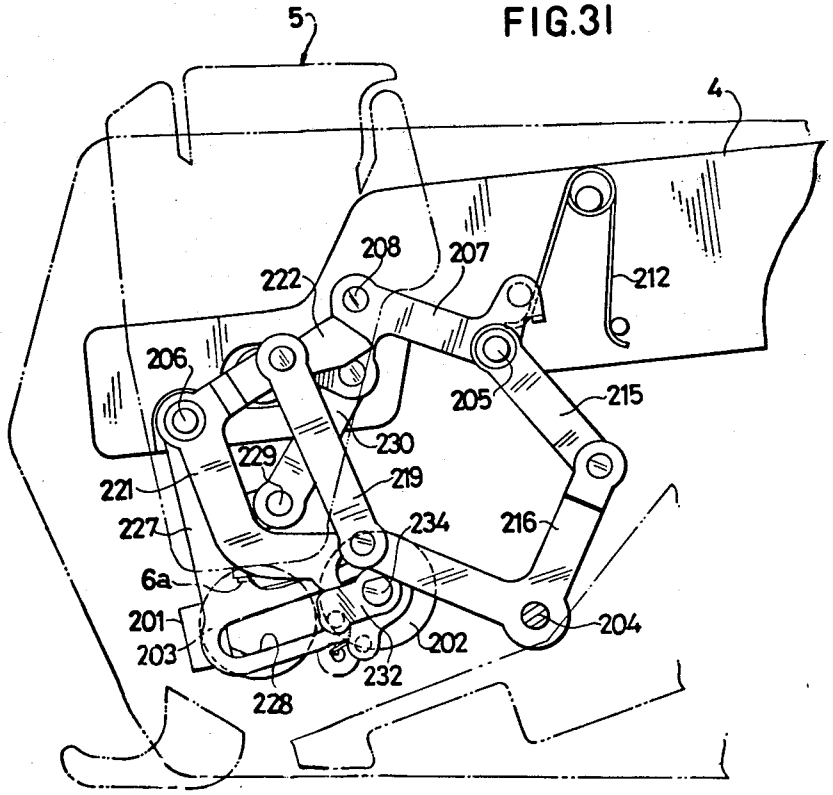

From the rest position of FIGS. 27 and 29, when the hand lever 2 is slightly squeezed (about 3°), the interlocked yoke arm 4 is turned counterclockwise (downward) about the pivotal shaft 3 into the state shown in FIG. 30.

The multi-link mechanism 200 attached to the yoke arm 4 is moved so that the push-up portion 222 of the rocking link 221 is brought into contact with the contact pin 208 of the operative link 207. Since the fixed pivots 205 and 206 on the yoke arm 4 are moved down, the movable pivot 217 of the action link 216 which pivoted at 204 to the machine frame 36, is moved to the right, and the other movable pivot 218 of the link 216 is moved almost upward. At the same time, the rocking link 221 is turned counterclockwise about the fixed pivot 206. The rocking link 221, which carries the supporting shaft 234 of the supporting member 236 and the inking roller frame 201 at the upper end of the slot 223 and under the force of the spring 225, causes the shaft 234 to slide to the right in the slot 228 of the guide link 227. In this movement, the first inking roller 202 is resiliently pressed to and rolled over the type faces **6*a* of the printing head 5, thereby causing the first inking, as shown in FIG. 30**.

Simultaneously with this first inking operation, the rocking link 221 is turned counterclockwise about the fixed pivot 206, so that the push-up portion 222 at the right hand end of the rocking link 221 is brought into contact with the contact pin 208 on the operative link 207 that is engaged with the other operative link 230. Then the link mechanism moves to the state shown in FIG. 31.

As the impact against the contact pin 208 by the push-up portion 222 exceeds the force of the spring 212, the operative link 207 is further turned clockwise, so that the engagement between the engaging lug 210 of the operative link 207 and other operative link 230 is released, and both of the links 207 and 230 assume an open or pushed up state with respect to each other. In other words, the operative link 207 turns clockwise about the fixed pivot 205, while the other operative link 230 turns counterclockwise about the movable pivot 229. Through this movement, the second inking roller 203 inks the type faces **6*a***.

When this inking action is completed, the supporting shaft 234 of the inking rollers reaches the right hand end of the slot 228 of guide link 227.

Figure 32:
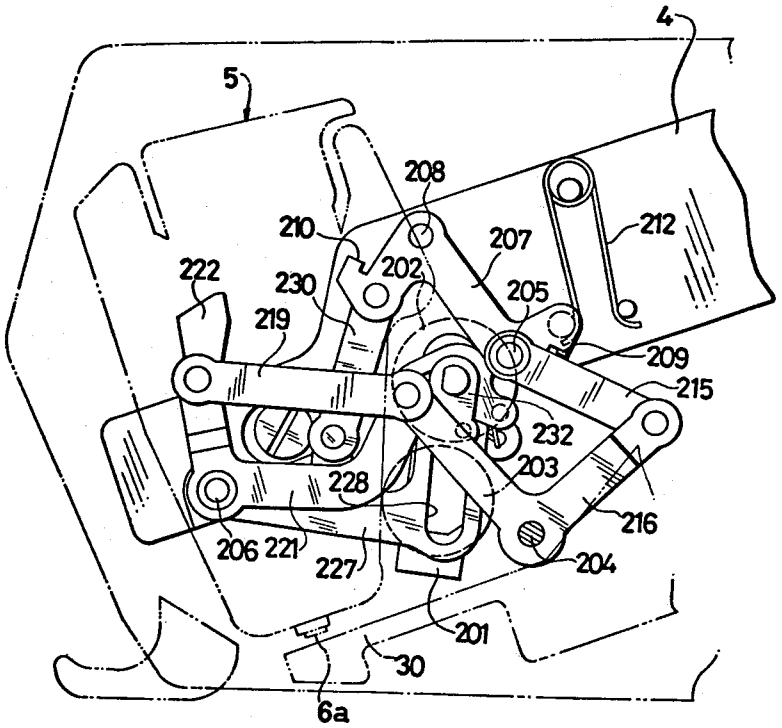
Figure 33:
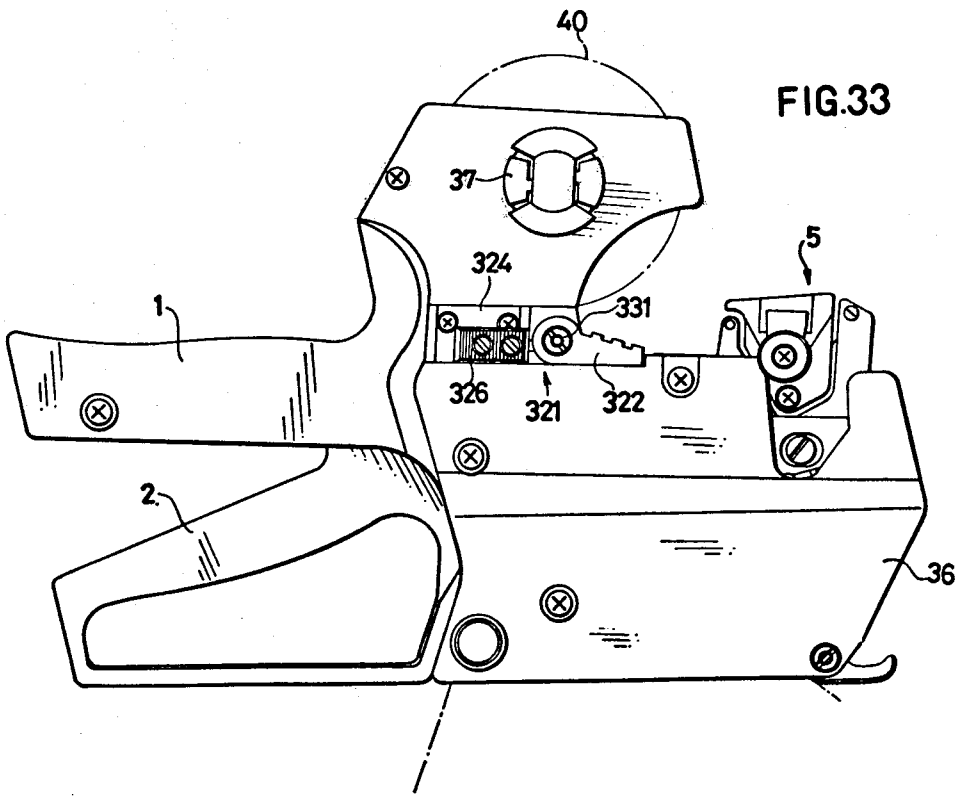

When the hand lever 2 is further squeezed, as shown in FIG. 32, the guide link 227 and the rocking link 221 are turned counterclockwise together. At the same time, the inking rollers are received in the middle portion of the machine frame 36. The inking roller frame 201 carrying two inking rollers is guided to the rear side of the printing head 5 and it is held vertically within the machine body. In this movement, the stop lug 209 of the operative link 207 comes into contact with the moving connecting link 215. The movement of each link can, therefore, be stopped. After the above described label printing action between the printing head 5 and the platen 30, the multi-link mechanism 200 is returned to the original rest position shown in FIG. 29 by releasing the hand lever 2.

Passing or Feeding Device for Label Strip

In the label passing or feeding device C, the label strip 41 which is supplied from a rolled label strip 40 supported on the body of label printing and applying machine, is transferred to the platen 30 through a label guide 333 and by the action of a delivery roller 60.

Figure 34:
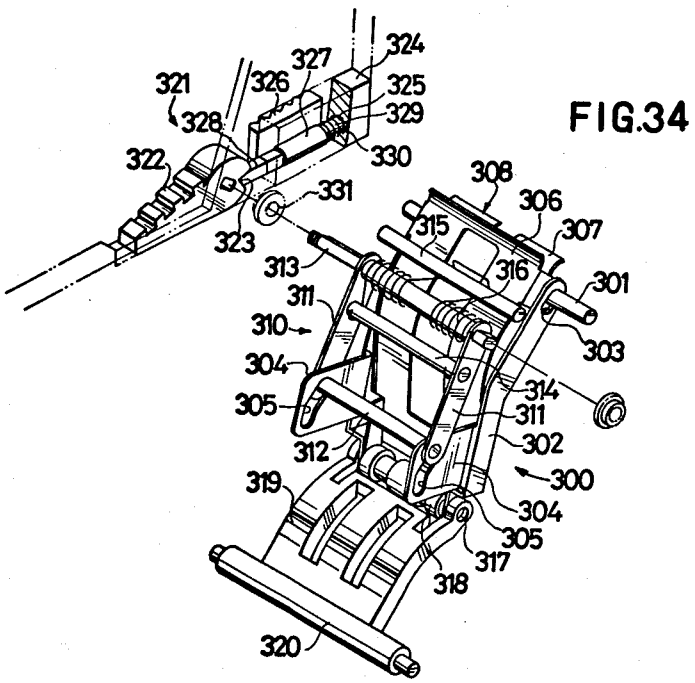
Figure 35:
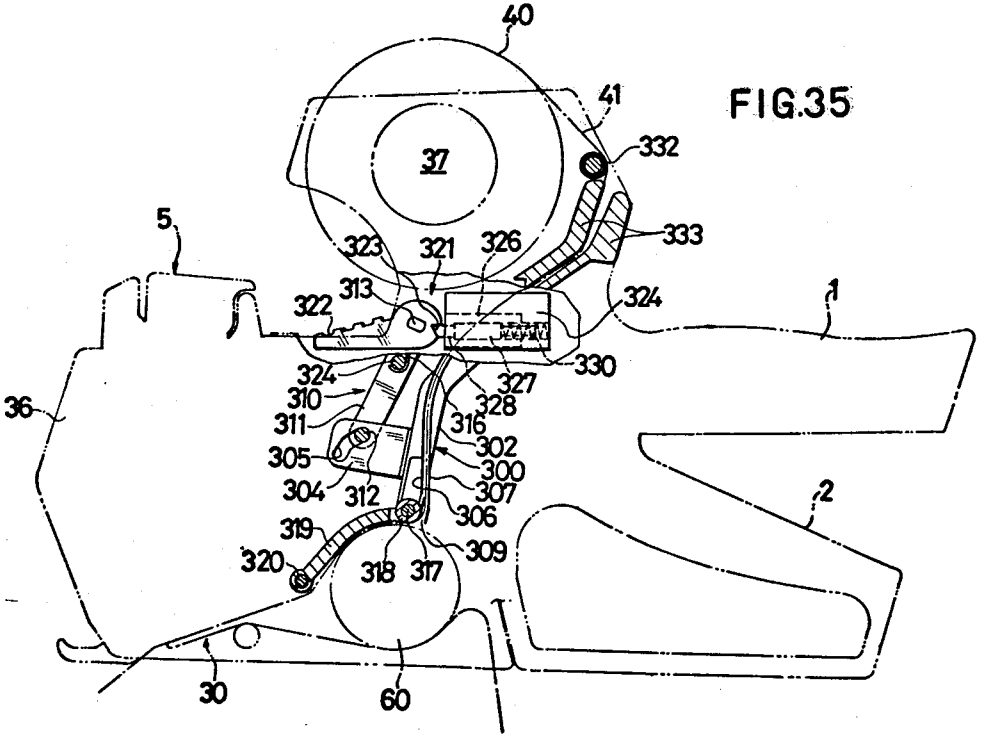

This label passing device C is shown in FIGS. 13 and 33 to 36. Referring to FIGS. 34 and 35, the label passing device C comprises a label holding section 300, an operating section 310 and a locking mechanism 321.

In the label holding section 300, a pair of label holding links 302 on both sides are supported by a pivot shaft 301 which is secured to the machine frames 36 and is inserted through the slots 303 formed in the end portions of the links 302. Located between the label holding links 302 are the opposed and spaced apart label front and rear (right and left sides as viewed in FIG. 35) guide plates 306 and 307. An upper opening 308 and a lower opening 309 are formed by the above label guide plates 306 and 307. The upper end portions of the label guide plates 306 and 307 near the upper opening 308 are bent outward so as to facilitate the insertion of the tape-like label strip 41. The lower ends of the label guide plates 306 and 307 are provided with a roller shaft 317 having label guide rollers 318 thereon.

Further, a label retaining member 319 is pivotally secured to the roller shaft 317 at one side edge of the member 319. The other side edge of member 319 is attached to a pivot shaft 320 that is secured to the machine frames 36. The label retaining member 319 has a fixed pivot shaft 320 on one side edge, the label holding links 302 having a fixed pivot shaft 301, and a pair of label guide plates 306 and 307 are movably joined about the foldable center of the roller shaft 317.

Each of the label holding links 302 is integrally provided with an arm plate 304 having a slot 305, to which slot 305 the operating section 310 is attached.

The operating section 310 comprises a pair of action links 311, a connecting rod 312 attached between the action links 311, an action rod 313 and a spring 316 fitted on the action rod 313. The extended portions on one side of the spring 316 are fitted to a spring pin 314 that is fixed between the action links 311. The other extended portion on the other side of the spring 316 is fitted to another spring pin 315 that is attached to the machine frames 36. Therefore, the action links 311 are always urged clockwise about the action shaft 313. Further, the label holding section 300 can be pulled apart from the delivery roller 60.

Each locking mechanism 321 comprises a locking member 324 secured to the machine frames 36 and a locking lever 322 opposed to the locking member 324. The end portions of the action rod 313 in the operating section 310 are inserted into the locking lever 322 and the thrust ends of the rod 313 have set screws 331 on them. Notch 323 is formed in one side end of the locking lever 322 near the locking member 324.

The locking member 324 is provided with a supporting rod 327 which is slidably inserted into sliding hole 325 formed in the member 324 and the supporting rod 327 carries slide piece 326. The supporting rod 327 has a fitting projection 328 at its one side end so as to fit the projection 328 to the notch 323 of the locking lever 322. The other end of the supporting rod 327 is provided with a thinned portion 329 which carries a spring 330 to urge the fitting projection 328 toward the notch 323.

Figure 36:
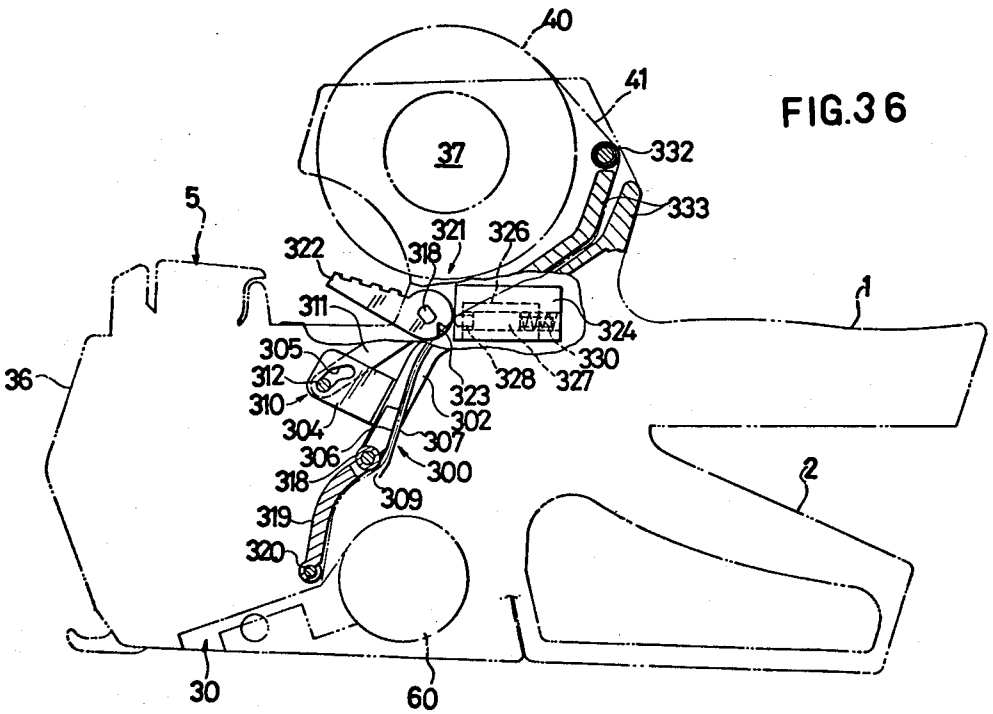

The procedure of feeding or passing the tape-like label strip 41 is now described. In order to pass the label strip 41, the slide piece 326 of the locking mechanism 321 is moved to the right as shown in FIG. 36 so as to disengage the fitting projection 328 from the notch 323 of the locking lever 322. Then the action links 311 are turned clockwise about the action rod 313 by the force of the spring 316 in the operating section 310. As a result, with the working of action links 311 and the connecting rod 312, the label holding section 300 is raised about the pivots of pivotal shafts 301 and 320.

The label strip 41 is passed from the roll 40 around the guide roller 332 attached to the machine frames 36 and between label guide members 333, and into the upper opening 308 formed between the front and rear label guide plates 306 and 307 of the label holding section 300. The label strip 41 passes through the space between both the label guide plates 306 and 307 and is then led out of the lower opening 309. The label strip 41 is inserted into the passageway leading toward the platen 30 through the space under the upraised guide roller 318 and the label retaining member 319.

After this label strip loading, the opened locking lever 322 is pushed down and counterclockwise. The fitting projection 328 of the supporting rod 327 is caught by the notch 323 of the locking lever 322 as shown in FIG. 35. In this operation, the action rod 313 in the operating section 310 is also turned against the force of spring 316 since the rod 313 is interlocked by an appropriate profile to pivot with the locking lever 322. With this action, the connecting rod 312 secured to the action links 311 is moved toward the label holding section 300 so that the label strip connecting rod 312 secured to the action links 311 is moved toward the label holding section 300. This brings the label strip 41 into engagement with the delivery roller 60. More particularly, the connecting rod 312 is moved toward the upper ends of the slots 305 and depresses the arm plates 304 of the label holding links 302, and the label guide plates 306 and 307 interlocked with the links 302 are turned counterclockwise about the pivot shaft 301. Together with this movement, the label strip retaining member 319 that is interlocked with the roller shaft 317 is turned clockwise about the pivot shaft 320. Thus, the arcuate inner surface of the label retaining member 319 is fitted to the outer surface of the delivery roller 60. After the label strip 41 is emplaced in the label passing device C, when the hand lever 2 is squeezed and released, the label strip 41 is moved forward.

Inertial Rotation Preventing Device for Delivery Roller

This device D is used for preventing the delivery roller from inertial rotation during its intermittent turning, so as to attain reliable delivery of a certain length of the label strip in interlocked movement with the squeezing and releasing of the hand grip and hand lever. The inertial rotation preventing device will be described with reference to FIGS. 37 and 38.

Figure 37:
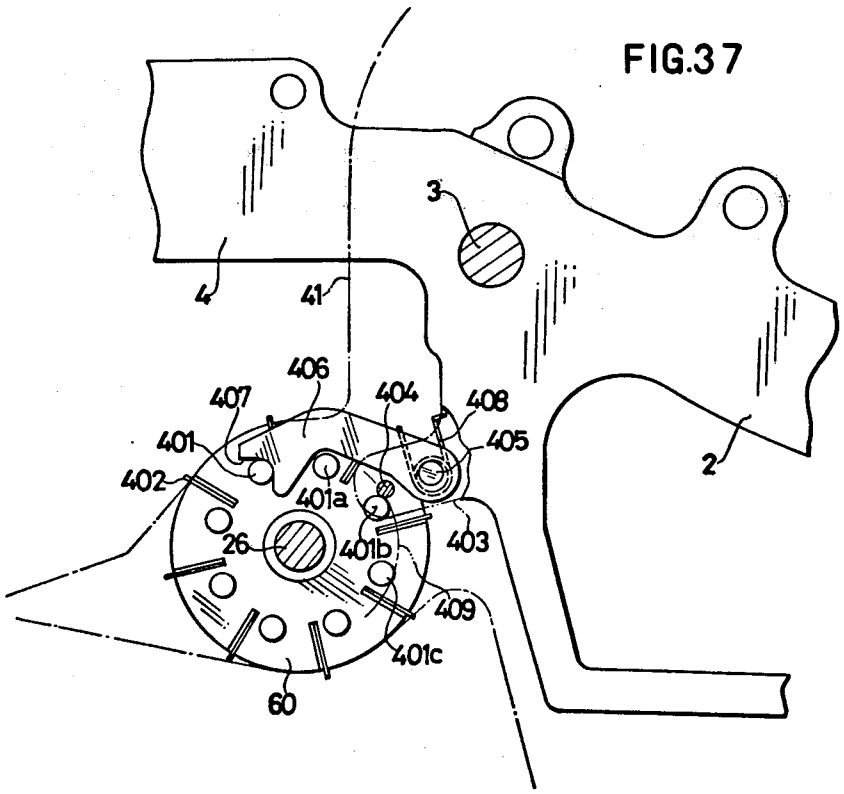

FIG. 37 shows the state in which the hand lever 2 is released. The delivery roller 60 that is rotatably attached to the pivotal shaft 26 is provided with a plurality of indexing pins 401, 401*a*, 401*b*, 401*c* . . . at regular angular intervals on the same radial positions of the side face. On the peripheral surface of the delivery roller 60 are disposed a pluraity of delivery plates or pins 402 in correspondence to the above indexing pins 401 and the plates 402 engage the cut lines 45 in the backing strip of the label strip (of FIG. 20).

The hand lever 2 is provided with a lug 403 on the front side surface thereof and the lug 403 is provided with a pivot shaft 405 carrying a delivery pawl 406, and an engaging pin 404 to be engaged with one of the above indexing pins 401. The pivot shaft 405 supports a spring 408 having one end fitted to the lug 403 and having the other end fitted to the delivery pawl 406. The spring 408 always urges the delivery pawl 406 counterclockwise so that, when the hand lever 2 is released, the pawl portion 407 is brought into engagement with one of the indexing pins 401. Further, the engaging pin 404 is positioned on the circular locus 409 of indexing pins 401, 401*a*, 401*b*, 401*c* . . . , so that the engaging pin 404 is also brought into contact with one of the indexing pins 401, 401*a*, 401*b*, 401*c* . . . .

Figure 38:
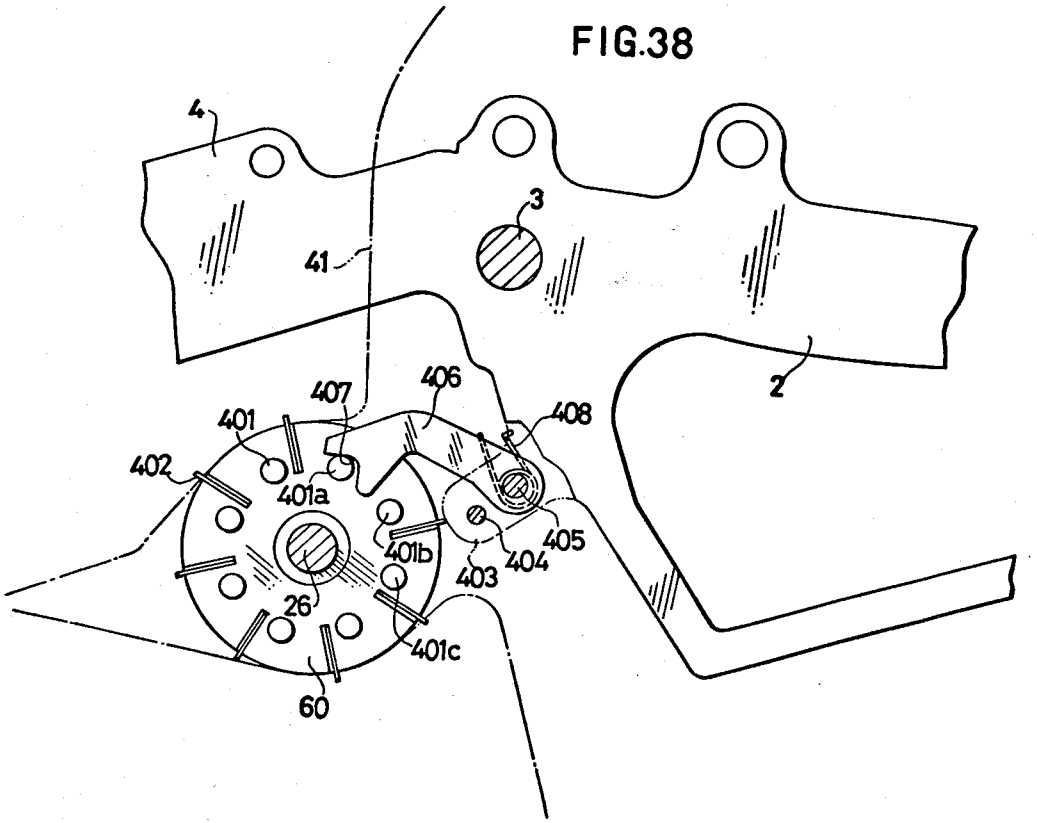

FIG. 38 shows the state when the hand lever 2 is squeezed. The delivery pawl 406 is retracted to the right and the engagement between the pawl portion 407 of the delivery pawl 406 and the indexing pin 401 is released. The pawl 406 comes into engagement with the next indexing pin 401*a*.

In the next step, when squeezing of the hand lever 2 is released, the device returns to the state shown in FIG. 37. The delivery pawl 406 now in engagement with the next indexing pin 401*a* is moved forward to the left. Thus, the delivery roller 60 is intermittently rotated counterclockwise about pivotal shaft 26 and the label strip 41 that is caught by the delivery plates 402 is advanced for a certain length, usually the length of one label piece.

At the final stage of this intermittent rotation of the delivery roller 60, the engaging pin 404 formed on the lug 403 comes into engagement with the indexing pin 401*c* so that the movement of the pin 401*c* in the counterclockwise direction is stopped. Accordingly, the delivery roller 60 is prevented from excess inertial rotation, and a label piece 41' of the label strip 41 is positioned correctly on the platen.

Peeling Regulating Device for Label Strip

Figure 39:
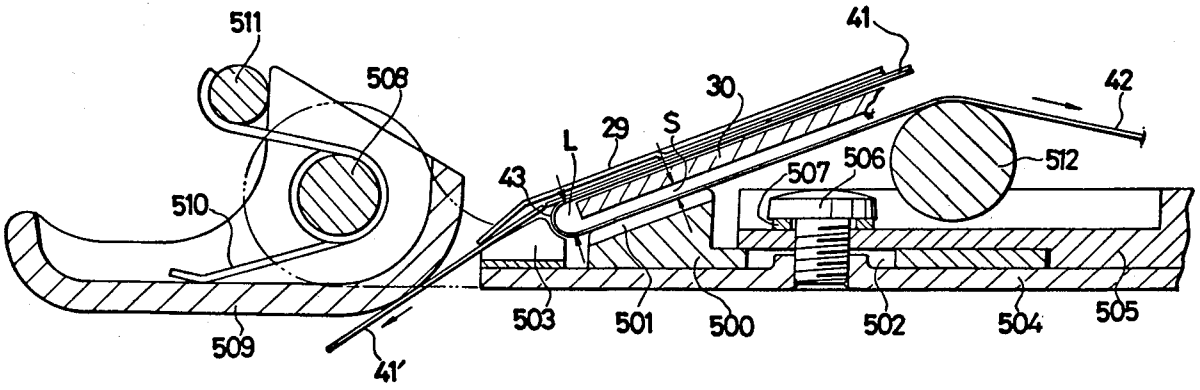

The tape-like label strip 41 of FIG. 39 comprises a tape-like backing strip 42 and a tape-like series of labels that have adhesive applied on their rear side and that are temporarily stuck on the backing strip 42. In the tape-like strip, pre-cut lines are formed at regular intervals so as to divide the label strip into a plurality of label pieces 41'. The peeling regulating device E is used for controlling the peeling of label pieces 41' from the backing strip 42.

The peeling characteristics of the tape-like label strips 41 delicately vary with the degree of stickiness of adhesives such as permanent adhesives, temporary adhesives, and adhesives for frozen foods, the water contents of label strips, the quality of paper for backing strips, the degree of silicone finishing of the backing strip, and so forth. The regulating device E controls the conditions of peeling in compliance with the variation of such factors.

The state of device E shown in FIG. 39 is before regulation, in which the regulating bed 500 is provided with a plurality of slanted ridges 501 like knife edges on the raised front portion thereof and with a regulating slot 502 in the middle portion thereof. The ridges 501 are brought into linear contact with the rear side of the backing strip 42. A set screw 506 having a washer 507 is secured to a movable bottom cover 504 and a movable inner bottom cover 505. The portion of regulating bed 500 having the slot 502 is interposed between the bottom cover 504 and the inner bottom cover 505. The set screw 506 is passed through the regulating slot 502 and the regulating bed along the longitudinal axis of the machine body (to the right and left in FIG. 39). The platen 30 is placed in opposed relation to the ridges 501 leaving a space S between them. There is a label holding leaf spring 29 above the platen. The guide roller 512 behind the space S guides the backing strip 42.

At the front end of the bottom cover 504, a guide block 503 for a cut label piece 41' is attached. The bottom cover 504 is pivotally secured to a shaft 508 which is attached to the machine frames (not shown). To the shaft 508 is secured label applicators 509 that are rocked against the force of a spring 510 also carried by the shaft 508. One end of this spring 510 is fitted to a supporting pin 511 on the machine frame and the other end of the spring 510 is fitted to the label applicators 509. Thus, the applicators 509 are urged counterclockwise or downward. When a label piece 41' is attached to the surface of an article, the label piece 41' is pressed by the applicators 509.

Figure 40:
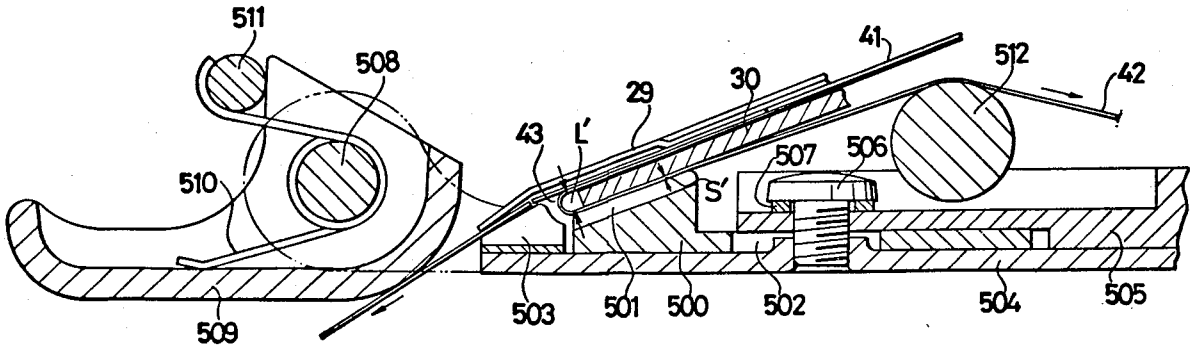

In the regulation of peeling, when the viscosity of adhesive of the label strip 41 is too large, the space S between the platen 30 and the ridges 501 of the regulating bed 500 is narrowed. To accomplish this, the regulating bed 500 is moved forward longitudinally through the regulating slot 502 and it is refixed to the bottom cover 504 by the set screw 506, thereby reducing the space S into the space S' as shown in FIG. 40. The diameter L in the bent portion 43 of backing strip 42 is reduced into the diameter L' so that the peeling of the label piece 41' from the backing strip 42 can be made easier.

Although the present invention has been described in connection with a number of preferred embodiments thereof, many variations and modifications will now become apparent to those skilled in the art. It is preferred, therefore, that the present invention be limited not by the specific disclosure herein, but only by the appended claims.

What is claimed is:

1. A constant printing pressure mechanism for a label printing machine:

said label printing machine comprising an operating lever movable between an operating condition and a released condition; a printing head attached to said operating lever and movable therewith toward a platen;

a platen disposed in opposition to said printing head so that a label on said platen may be imprinted by said printing head;

said constant printing pressure mechanism comprising: platen raising means for raising said platen against said printing head, said platen raising means comprising an action lever movable with respect to said platen; said action lever including engageable means;

action lever engaging means normally in engagement with said engageable means for restraining motion of said action lever under the influence of a constant pressure spring;

a constant pressure spring connected with said action lever and adapted to be charged as said operating lever is being moved to its said operating condition, thereby to bias said action lever to move in one direction, which said movement of said action lever is restrained by said action lever engaging means;

release means connected with said operating lever for releasing the engagement between said action lever engaging means and said engageable means upon motion of said operating lever over a predetermined distance towards said operating condition, thereby releasing the charged said spring to discharge and to move said action lever in said one direction, and said predetermined distance is such that said printing head is in condition to be engaged by a label on said platen when said platen is raised;

first impact means connected with said action lever to move therewith; second impact means connected with said platen; said first and said second impact means being so placed that after predetermined motion of said action lever in said one direction thereof under the influence of the discharging said spring, said first and said second impact means meet, and said platen and said impact means being so placed and so connected that upon such meeting of said first and said second impact means, said platen moves to said print head.

2. The constant printing pressure mechanism of claim 1, further comprising platen return means for returning said platen off said printing head immediately after said platen engages a label against said printing head.

3. The constant printing pressure mechanism of claim 2, wherein said platen return means comprises a release spring normally urging said platen away from said printing head and adapted to move said platen away from said printing head.

4. The constant printing pressure mechanism of claim 1, wherein said action lever engaging means comprises a hook and means for biasing said hook into continuous engagement with said engageable means;

said spring being connected to said operating lever to be charged by motion of said operating lever toward its said operating condition;

said release means being positioned on said operating lever to abut said hook and disengage said hook from said engageable means.

5. The constant printing pressure mechanism of claim 1, wherein said first and said second impact means respectively comprise first and second impact rollers on said action lever and said platen; said first and said second impact rollers being normally separated and being positioned to come together after a predetermined distance of motion of said action lever under the influence of said constant pressure spring.

6. The constant printing pressure mechanism of claim 1, wherein said platen is pivotally attached to said label printing machine, whereby said platen pivots toward said printing head and pivots away therefrom.

7. The constant printing pressure mechanism of claim 6, wherein said operating lever is pivotally attached to said label printing machine at a different pivot location than said platen.

8. The constant printing pressure mechanism of claim 1, wherein said platen is pivotally attached to said label printing machine, whereby said platen pivots toward said printing head and pivots away therefrom.

9. The constant printing pressure mechanism of claim 8, wherein said operating lever is pivotally attached to said label printing machine at a different pivot location than said platen.

10. The constant printing pressure mechanism of claim 9, wherein said printing head is attached to said operating lever to be pivoted therewith toward said platen and said platen being pivotable toward said printing head.

* * * * *